United States Patent [19]

Fusco et al.

[11] 3,964,147

[45] June 22, 1976

[54] CONNECTOR ASSEMBLY MACHINE

[75] Inventors: Vito A. Fusco, Palos Hills, Ill.; Ove Christian Carlsen, Round Rock, Tex.; Steven F. Wright, Glen Ellyn, Ill.

[73] Assignee: Molex Incorporated, Lisle, Ill.

[22] Filed: Jan. 2, 1975

[21] Appl. No.: 538,188

[52] U.S. Cl. ..... 29/203 B; 29/203 P; 29/203 MW; 29/206 R

[51] Int. Cl.[2] ..... H01R 43/00

[58] Field of Search ..... 29/203 MW, 203 P, 203 B, 29/203 DT, 33 M, 206, 629

[56] References Cited

UNITED STATES PATENTS

| | | | |
|---|---|---|---|
| 3,611,544 | 10/1971 | Frels et al. | 29/203 B |
| 3,641,651 | 2/1972 | Rockwell, Jr. et al. | 29/203 B |
| 3,737,998 | 6/1973 | Byrd | 29/203 P |
| 3,766,624 | 10/1973 | Grebe et al. | 29/203 MW |

*Primary Examiner*—Carl E. Hall
*Attorney, Agent, or Firm*—Louis A. Hecht

[57] ABSTRACT

A connector assembly machine accepts wires having terminals attached thereto which are loaded manually by an operator, and inserts the terminated wires into predetermined positions, in a multi-cavity connector housing. The housing is indexed to a predetermined sequence of positions relative to an insertion assembly, and wires are arranged in bins adjacent a loading station in an array corresponding to the insertion sequence. Loading of each terminated wire initiates a cycle of operation wherein the terminated wire is gripped at the loading station, transferred to the insertion station, and inserted into the proper housing cavity.

43 Claims, 31 Drawing Figures

Fig. 1
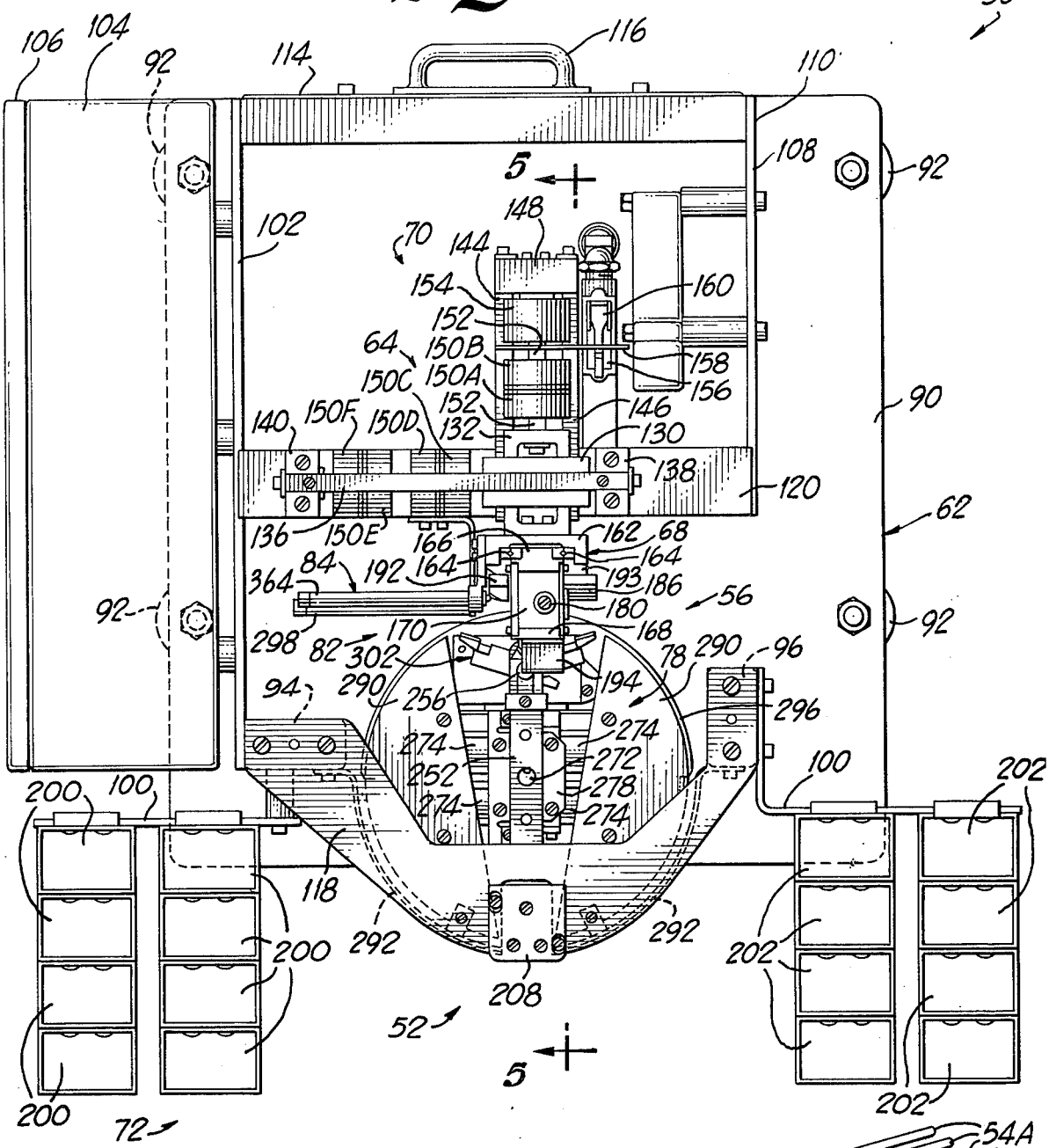
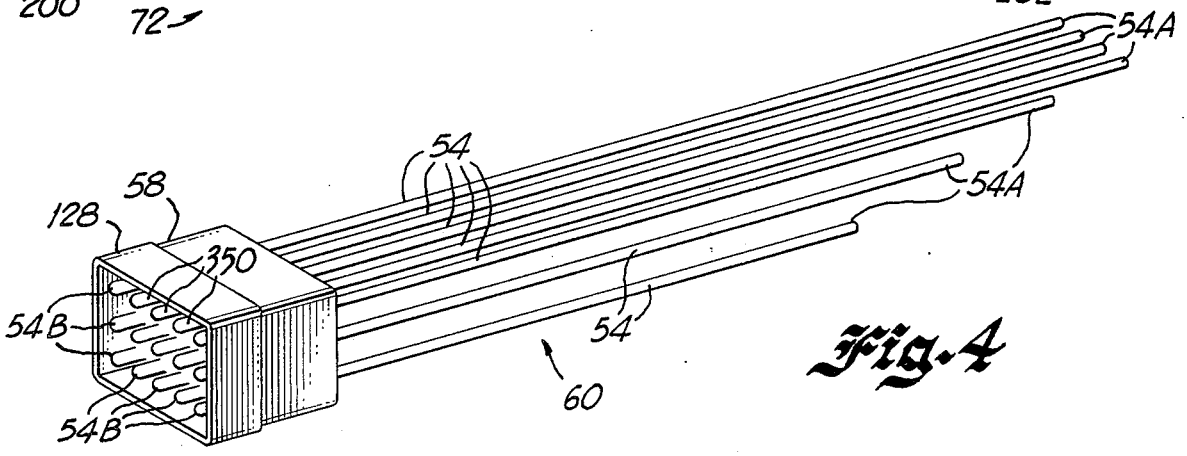
Fig. 4

50
64
68
180
166
162
172
168
182
66
194
132
150A
70
150B
160
158
154
148
146
138
186
292
208
204
240
118
206
74
212
78
210
80
290
222
230
238
52
228
76
236
235
234
270
304
80
314
296
310
312
274
193
120
156
300
102
302
330
334
342
336
338
100
340
82
56
202
72
344
356
358
360
98
110
114
116
108
112
100
96
90
62
92
92

70
56
64
10
140
136
152
150F
150D
162
166
170
180
68
164
174
184
172
178
182
138
186
190
176
192
193
120
110
66
134
364
150E
150C
84
366
368
370
332
112
298
300
330
62

120
144
146
132
64
28
332
164
166
68
162
366
192
190
193
188
364
186
80
370
368
84
128
126
58
182
66
174
172
168
244
242
194
256
252
262
78
280
98
278

168
172
180
166
162
64
68
178
170
182
176
58
128
84
188
132
186
194
66
192
330
193

168
172
180
166
162
64
68
178
170
182
176
128
188
132
186
194
66
58
330
193

168
172
180
166
162
64
68
178
170
182
176
128
188
132
194
66
58
186
330
193

Fig. 20
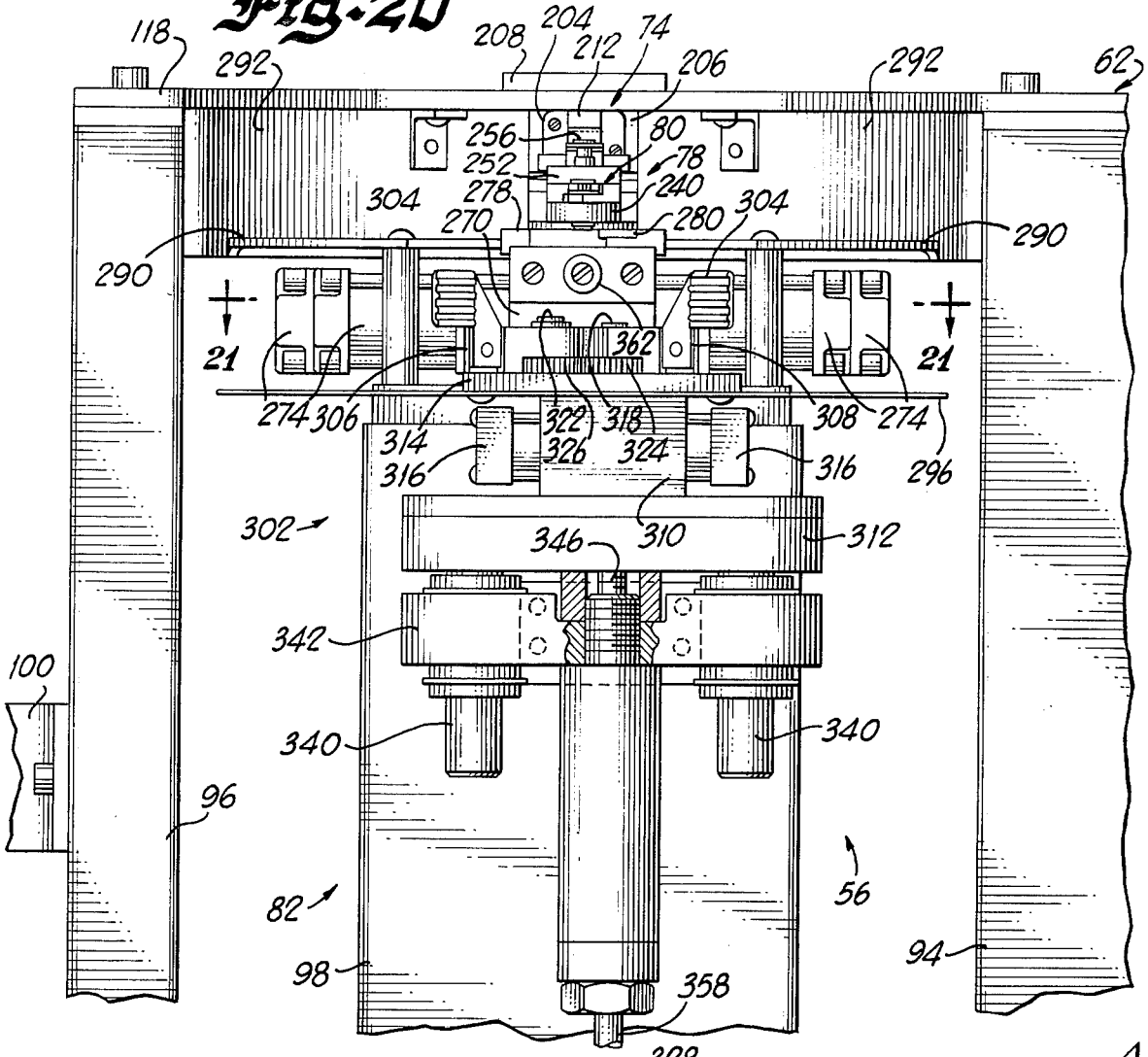
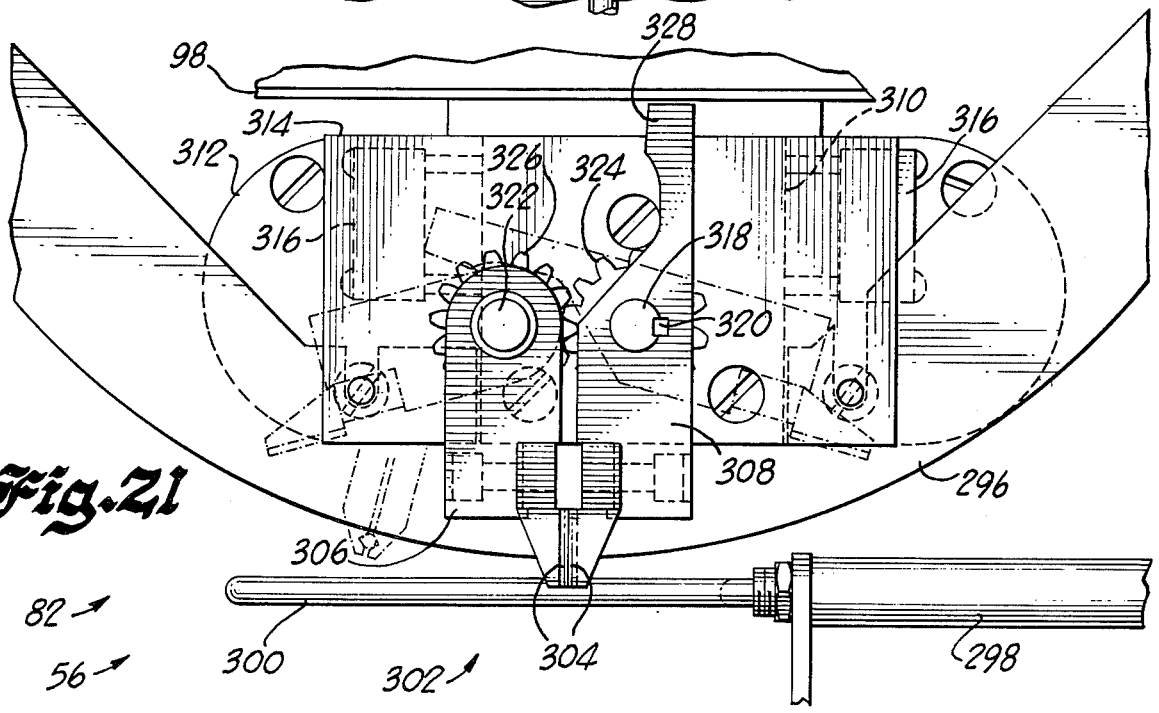
Fig. 21

70
150A
144
150C
152
130
120
136
142
134
140
132
102
112
162
164
190
188
192
370
366
368
84
193
56
330
332
166
174
298
300
184
25
128
126
124
122
242
244
80
548
82
54
544
310
296
304
308
290
314
316
180
170
64
68
168
178
66
182
176
58
256
258
260
318
302
324
194
248
262
250
362
328
254
280
282
118
94
78
252
240
274
270
62
98

174
176
190
128
126
126
164
58
186
122
122
182
166
350
242
124
332
124
242
242
352
352
354
354
193
54B
348
330
54
302
304
304
54A
300

132
166
164
164
162
68
64
366
192
193
186
54B
58
128
350
126
352
364
370
190
188
368
84
182
66
174
172
168
194

SOURCE OF PRESSURIZED AIR
88
234
235
270
272
310
318
154
150A
150B
150C
150D
150E
150F
152
364
368
330
332
334
344
346
358
298
300
408
410
412
414
416
420
422
428
430
432
434
436
438
442
444
404A
404B
404C
404D
404E
404F
406A
406B
406C
406D
406E
406F

CONNECTOR ASSEMBLY MACHINE

The present invention relates to an improved machine for automatically assembling terminated wires at predetermined positions in a connector housing.

At one time the fabrication of wiring systems for automobiles, appliances, electronic devices and the like was a manual operation in which wires would be installed one at a time and interconnected with various components as by screw connectors or soldering. The expense and inconvenience of this type of hand assembly has led to the development and wide use of prefabricated wiring harnesses incorporating some or all of the wiring required for a particular device. In many instances, such harnesses include electrical connectors of the type including an insulating housing within which are captured a number of terminals, each attached to an individual wire as by a crimp connection. Examples of electrical connectors widely used for this purpose are disclosed in U.S. Pat. No. 3,178,673 - Krehbiel and U.S. Pat. No. 3,645,279 - Krehbiel.

In the manufacture of wiring harnesses and similar assemblies, the first step normally is to prepare a quantity of wires of desired lengths and types, and to attach a terminal to an end of each wire. Automated equipment is available for cutting a supply of wire into segments of the desired lengths and for stripping the insulation from the wire ends. Machinery is also available for accepting terminals in strip or chain form, and for crimping terminals to the ends of the wires. For the purposes of the present application, the term "terminated wire" is used to denote a segment of wire together with a terminal attached thereto.

Although automated machinery has reduced the cost of preparing the terminated wires for a harness assembly, the process of assembling the terminated wires into a connector housing has never been successfully automated and remains largely an expensive, slow and not always reliable hand operation. Typically, the assembler must manually hold each terminated wire and insert the terminal portion into its corresponding housing cavity to a fully inserted position where it is captured by a locking structure on the terminal and housing. Problems which may arise from hand assembly include high labor costs, the possibility of incomplete terminal insertion, and the possibility of misassembly.

Serious difficulties are encountered in any attempt to carry out a harness fabrication operation with automatic equipment. A terminated wire is an awkward item to handle and transport with machinery due to its flexibility and its tendency to tangle with other wires. This problem is compounded in the usual harness assembly because several wires usually of widely differing lengths and often of different diameters may be used. Commercially available general purpose automated equipment, such as numerically controlled equipment, is not practical for this purpose because of its cost and because it is not well suited for a relatively large number of relatively small batch operations.

A primary object of the present invention is to provide a connector assembly machine for assembling terminated wires into connector housings, thereby automatically to fabricate wiring harnesses or similar assemblies. Other important objects are to provide a connector assembly machine capable of rapid and reliable operation; to provide a machine which can easily and conveniently be operated by one person; to provide a machine which can readily be set up for use with different types of housings and for different wiring sequences and arrangements; to provide an indexing structure for accurately positioning a connector housing in a sequence of positions; to provide a machine including novel structure for receiving a terminated wire at a loading station and for transporting it away from the loading station to an insertion station for insertion into a housing; to provide novel transfer and insertion assemblies for handling an inserted terminated wire; and to provide improved structural features and control arrangements in a connector assembly machine.

In brief, in accordance with the above and other objects of the present invention, there is provided a connector assembly machine for inserting terminated wires into a connector housing in a predetermined sequence. The machine includes an index head assembly for supporting the connector housing adjacent an insertion station, and an indexing structure aligns the housing cavities to receive terminated wires in the predetermined sequence.

A loading station is provided to receive terminated wires hand loaded by an operator. Bins are arranged to both sides of the loading station to hold terminated wires in an array corresponding to the insertion sequence in such a way that the terminated wires may be loaded rapidly with alternate hands.

Upon loading of a terminated wire, a sensing means at the loading station operates a control means to retract a wire loading guide and to operate a transfer assembly for movement of the terminated wire from the loading station to the insertion station. The transfer assembly includes a pair of spaced gripping devices, and the transfer assembly is movable to position one gripping device at the loading station while the other gripping device is at the insertion station. This movement is in alternate directions to accommodate alternate hand loading of terminated wires. Upon actuation of the sensing means, the gripping device at the loading station grips the inserted wire, and the transfer assembly pulls the wire from the operator's fingers toward the insertion station while returning the other gripping device to the loading station for the loading of the next terminated wire.

Arrival of a terminated wire at the insertion station begins operation of an insertion assembly including an insertion gripping device which grips the wire. The housing, properly aligned by the indexing structure, and the terminated wire move toward one another until the terminal is accurately started into the desired housing cavity. At this time the transfer gripping device is released and insertion continues until the terminal is fully seated. A movable insertion guide prevents tangling of the inserted terminated wire with those previously inserted in the housing. An ejection mechanism discharges the completed assembly from the machine after the full insertion sequence has been carried out.

The invention together with the above and other objects and advantages thereof may best be understood from the following detailed description of the embodiment of the invention illustrated in the accompanying drawings, wherein:

FIG. 1 is a top view of a connector assembly machine constructed in accordance with the present invention;

FIG. 4 is a perspective view of a wiring harness or similar assembly assembled by the machine of FIG. 1;

FIG. 20 is a sectional view taken along the line 20—20 of FIG. 5 and illustrating components associated with the insertion station of the machine;

FIG. 21 is a sectional view taken along the line 21—21 of FIG. 20;

FIG. 28 is a fragmentary sectional view taken along the line 28—28 of FIG. 10 illustrating the housing ejection assembly of the machine;

INTRODUCTION AND GENERAL DESCRIPTION

Figure 2:
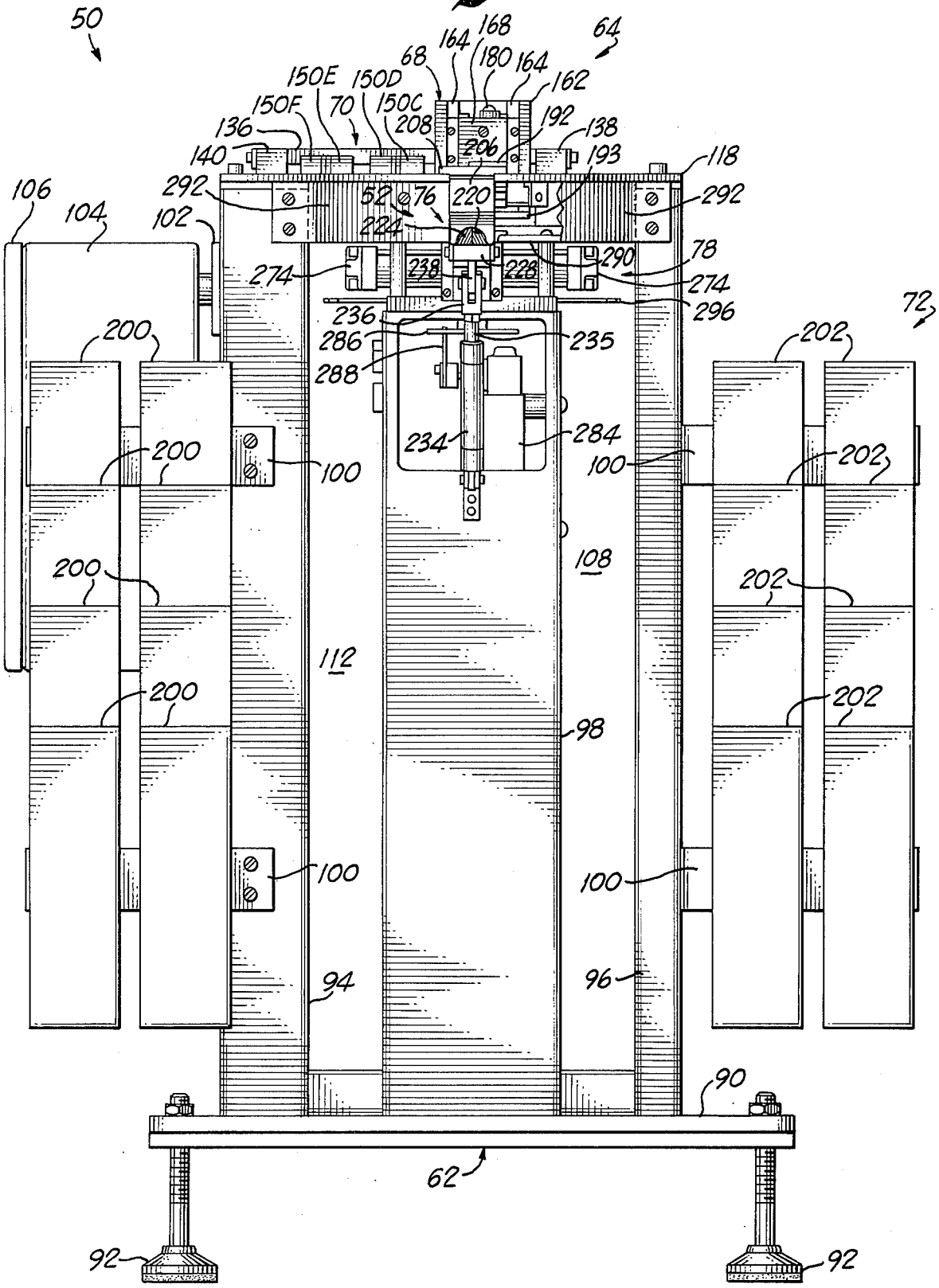
FIG. 2 is a front view of the machine.

Having reference now to the accompanying drawings, there is illustrated a connector assembly machine designated as a whole by the reference numeral 50 and constructed in accordance with the principles of the present invention. The machine 50 includes a loading station generally designated as 52 where terminated wires 54 are received into the machine. In the illustrated arrangement, each terminated wire includes a segment of insulation clad wire 54A to one end of which is attached an electrical terminal 54B. The machine 50 further includes an insertion station generally designated as 56 where terminated wires are inserted into a connector housing 58. In accordance with the invention, the machine functions in an automatic manner to assemble terminated wires 54 inserted into the machine in a predetermined sequence into desired positions in the connector housing 58 to fabricate a completed wiring harness or similar assembly illustrated in FIG. 4 and designated as a whole by the reference numeral 60.

The various components of the machine are carried by a support or frame structure designated in its entirety by the reference numeral 62. Supported by the frame 62 in the vicinity of the insertion station 56 is a housing support structure generally designated by the reference numeral 64 and best illustrated in FIGS. 3, 5, 7, 9–13, 22–24 and 29. The support structure 64 includes a nest block assembly generally designated as 66 accepting the housing 58 and in turn supported by an index head assembly generally designated as 68.

In accordance with a feature of the invention, there is provided an indexing assembly generally designated as 70 and best illustrated in FIGS. 1, 5, 7 and 9. The indexing assembly 70 functions sequentially to orient the connector housing 58 relative to the insertion station 56 so that terminated wires 54 loaded into the machine 50 are inserted into the connector housing 58 in a predetermined sequence of positions.

Another feature of the present invention resides in the provision of a bin structure generally designated as 72 (FIGS. 1–3) for supporting a supply of terminated wires 54 to be used in the fabrication of wiring harness 60. In a typical wiring harness assembly, various ones of the wires 54A have different lengths, and moreover may differ in other characteristics such as wire gauge, insulation characteristics and the like. In the use of the machine 50, a number of similar harnesses 60 may be fabricated one after the other. The bin structures 72 support groups of terminated wires 54 in an array corresponding to the operation of the indexing assembly 70 to the end that the operator of the machine 50 can load terminated wires 54 into the insertion station 56 with alternate hands for maximum speed and convenience.

Figure 14:
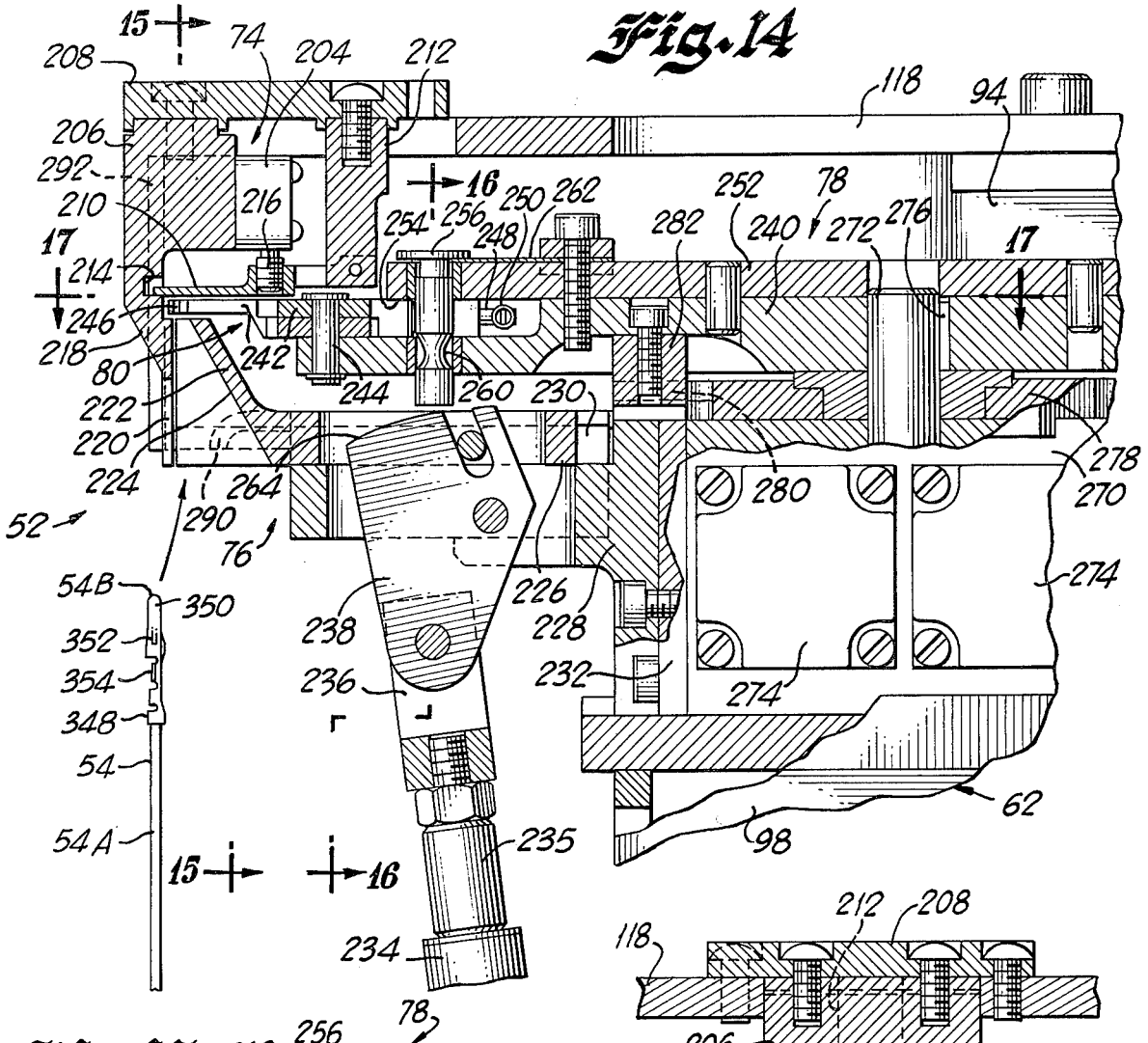
FIG. 14 is a sectional view on an enlarged scale taken along the line 14—14 of FIG. 7 and illustrating components of the machine associated with the loading station.
Figure 16:
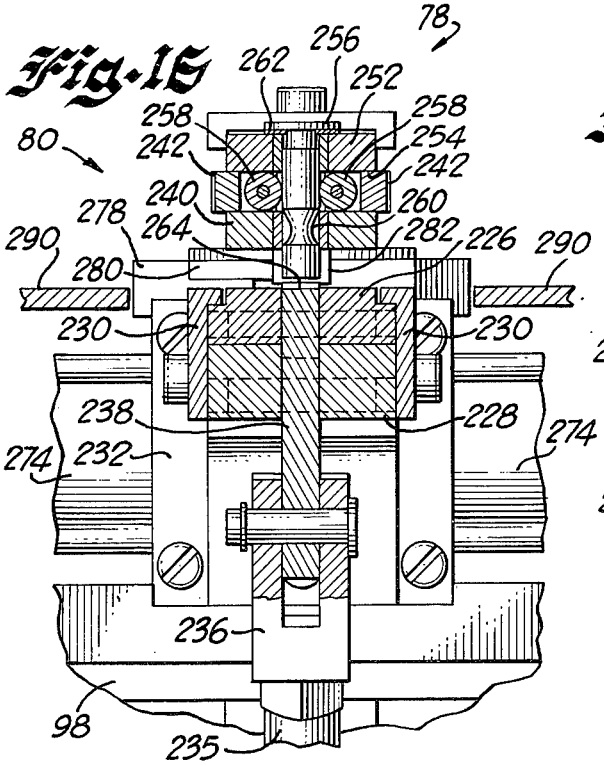
FIG. 16 is a sectional view taken along the line 16—16 of FIG. 14.
Figure 15:
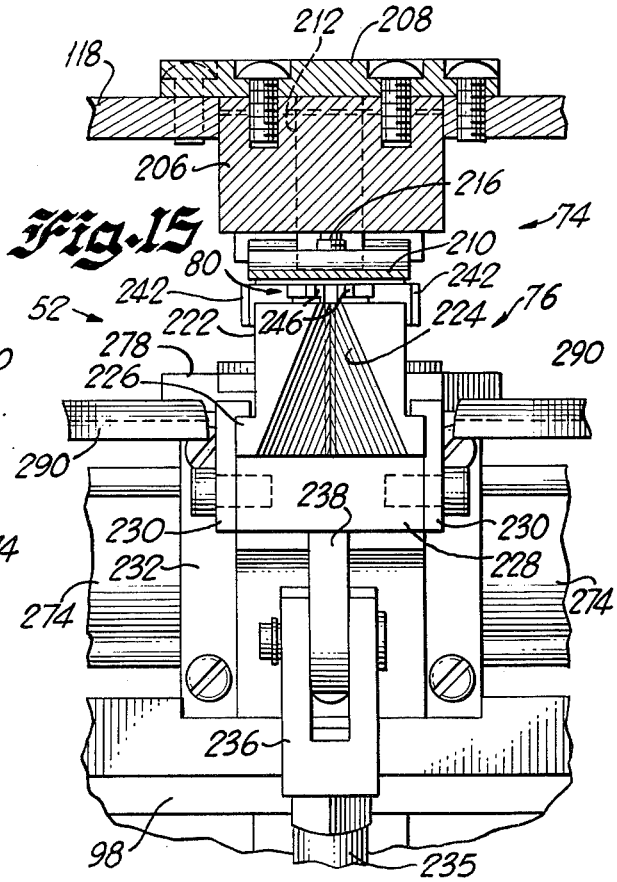
FIG. 15 is a sectional view taken along the line 15—15 of FIG. 14.
Figure 17:
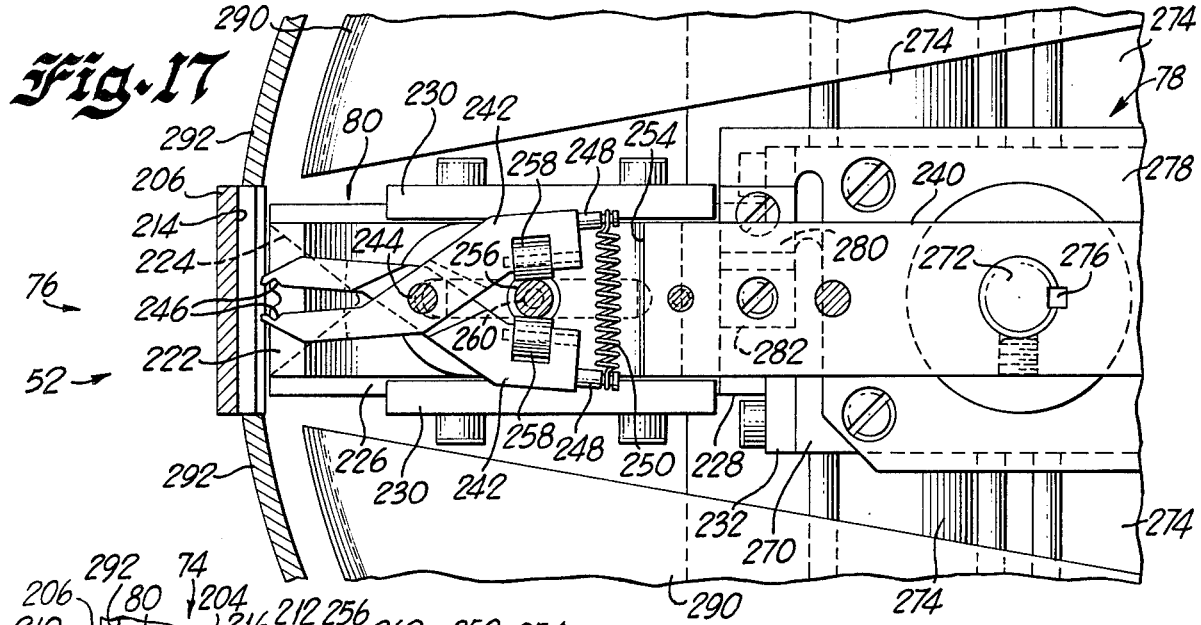
FIG. 17 is a sectional view taken along the line 17—17 of FIG. 14.
Figure 18:
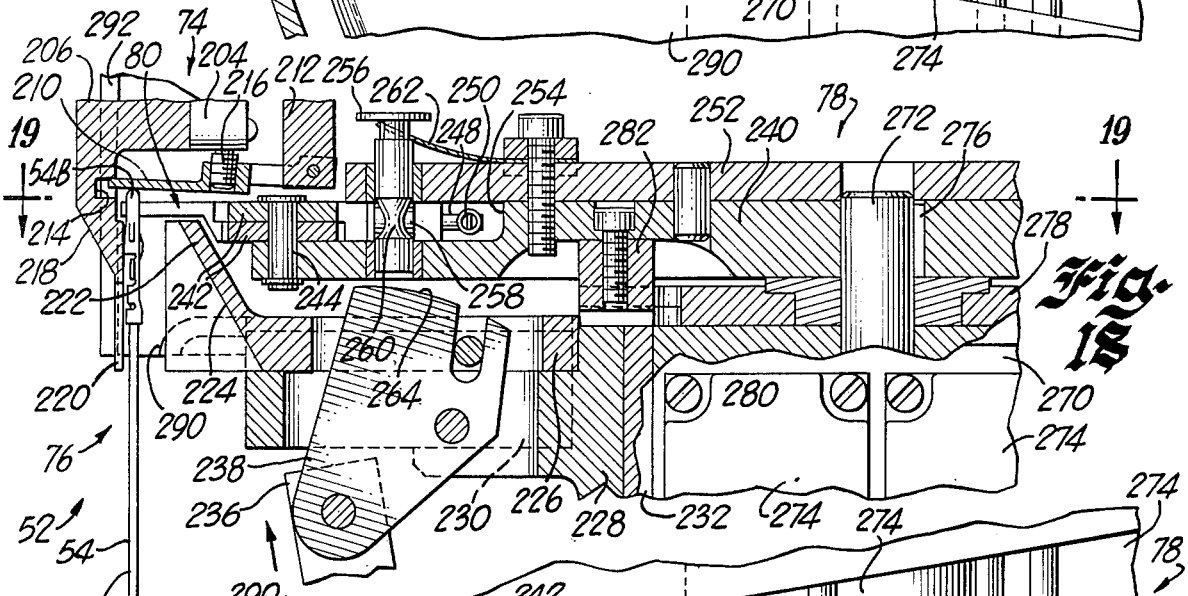
FIG. 18 is a view similar to FIG. 14 illustrating the loading of a terminated wire at the loading station of the machine.

In order to initiate a cycle of operation of the machine 50, a start switch assembly generally designated as 74 and best illustrated in FIGS. 14 and 18 is associated with the loading station 52. A loading guide assembly generally designated as 76 and best shown in FIGS. 14, 15 and 19 guides a terminated wire 54 into the loading station 52 and in accordance with the invention this structure is retracted after loading to permit movement of the terminated wire from the loading station 52.

Another important feature of the present invention resides in the provision of a transfer assembly designated as a whole by the reference numeral 78 and including a spaced pair of similar transfer gripping assemblies 80. The assemblies 78 and 80 are best illustrated in FIGS. 5, 7 and 14–19 of the drawings. The transfer assembly 78 functions to transfer terminated wires 54 from the loading station 52 to the insertion station 56, and in accordance with one feature of the invention, one of the gripping assemblies 80 is positioned at the loading station while the other assembly 80 is positioned at the insertion station 56. This arrangement enhances the speed of operation of the machine 50. In accordance with another feature of the invention, the transfer assembly 78 withdraws terminated wires 54 from the loading station 52 in alternate directions in order to pull the wires 54A from the fingers of alternate hands of the machine operator.

Additional features of the present invention relate to the structure and operation of an insertion assembly generally designated as 82 and illustrated in FIGS. 3, 5, 7, 8 and 20–27 of the drawings. The insertion assembly 82 is associated with the insertion station 56 and functions to receive terminated wires from the transfer assembly 78 and to insert the terminated wires 54 in sequence into the connector housing 58 carried by the housing support structure 64.

Figure 9:
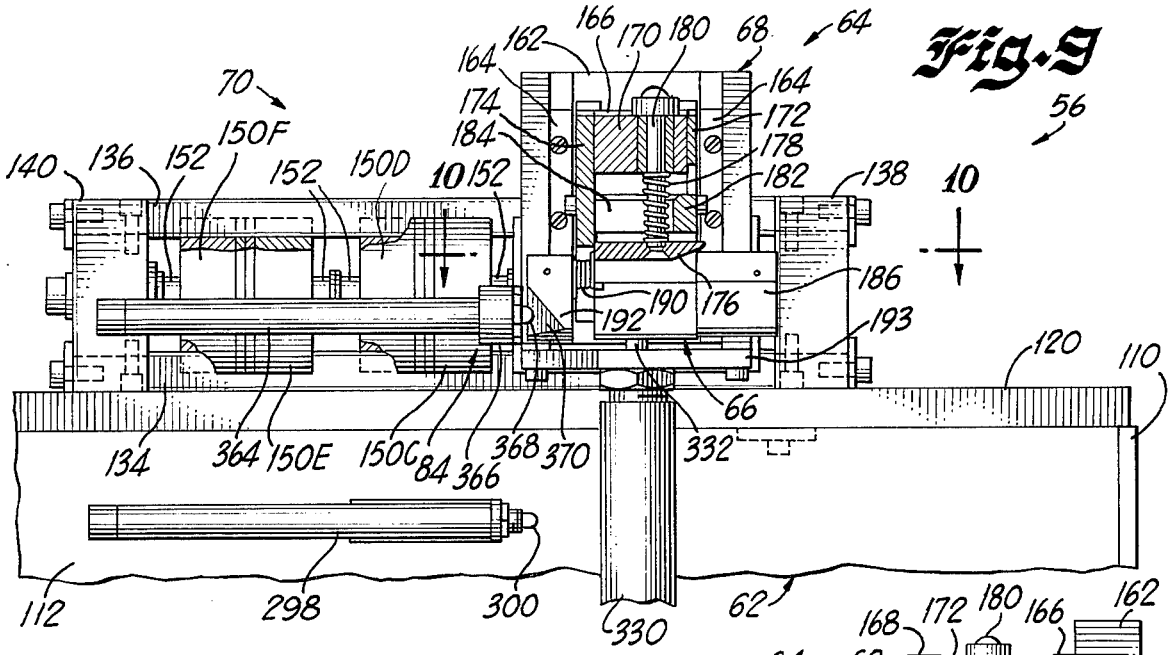
FIG. 9 is a sectional view taken along the line 9—9 of FIG. 5 illustrating portions of the housing support structure and indexing assemblies of the machine.
Figures 25, 26, 27, 29:
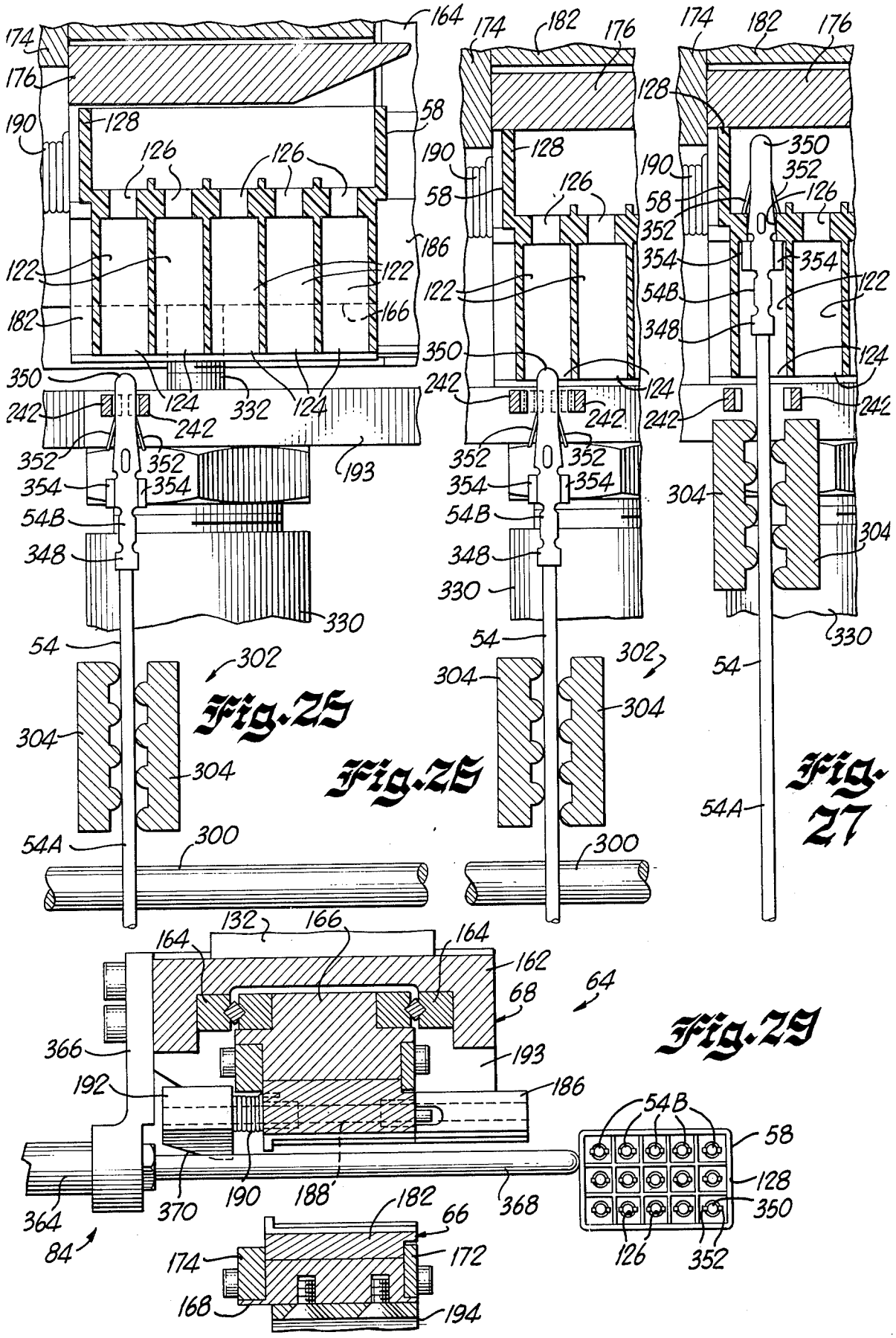
FIG. 25 is an enlarged fragmentary sectional view taken along the line 25—25 of FIG. 22.
FIG. 26 is a view similar to FIG. 25 taken along the line 26—26 of FIG. 23.
FIG. 27 is a view similar to FIG. 25 taken along the line 27—27 of FIG. 24.
FIG. 29 is a sectional view on an enlarged scale similar to a portion of FIG. 10 and illustrating the housing ejection assembly of the machine.

When a full sequence of insertion operations has been carried out by the insertion assembly 82, a housing ejection assembly generally designated as 84 functions to discharge a completed wiring harness 60 from the machine 50. The housing ejection assembly 84 is best illustrated in FIGS. 9, 28 and 29.

Automatic operation of the components of machine 50 in response to the loading of terminated wires 54 at the loading station 52 is carried out by means of an electrical control circuit generally designated as 86 and a pneumatic control circuit generally designated as 88. These circuits are illustrated in simplified and schematic form respectively in FIGS. 30 and 31.

FRAME STRUCTURE

Proceding now to a more detailed description of the components and operation of the machine 50, the frame or support structure 62 includes a base member 90 upon which are mounted a number of support feet 92. Preferably the feet 92 are adjustable with respect to base member 90 for positioning the machine 50 in a convenient position relative to a supporting floor surface.

Extending upwardly from the base 90 are a left and a right support column 94 and 96. A center column 98 is located between the columns 94 and 96. The bin structure 72 is supported at the front of the machine 50 by a number of bin support brackets 100 attached to the columns 94 and 96.

A wall member 102 is located at the left side of the machine and is attached to the left support column 94.

A control box 104 is carried by the wall 102 and encloses many of the components of the electrical control circuit 86. Access to the box 104 is provided by a door 106.

Many of the components of the pneumatic control circuit 88 are supported within a housing 108 formed by the wall 102, a right side wall member 110 and a front wall 112 located to the rear of the columns 94, 96 and 98. A back panel 114 is removable through the use of a handle 116 for access to the housing 108.

Structure associated with the loading station 52 is supported in part by means of a front support plate 118 attached to and extending between the support columns 94 and 96. Similarly, structure associated with the insertion station 56 is supported in part by a support bar 120 extending between the walls 102 and 110.

Preferably, the top and sides of the machine 50 are covered in use by means of suitable cover structures, such structures not being illustrated in the drawings for purpose of clarity. If desired, the top cover structure may be arranged to hold a supply of empty connector housings 58 to be inserted into the nest block assembly 66 following operation of the housing ejection assembly 84 at the end of a sequence of insertion operations. In accordance with known practice, a vibratory feeding arrangement may be provided for supplying the housing 58 one at a time to the operator.

HOUSING SUPPORT STRUCTURE AND INDEXING ASSEMBLY

The versatility of the machine 50 is enhanced by the fact that the machine may easily be set up to assemble terminated wires 54 into connector housings of many types and configurations. In the illustrated arrangement, the machine is arranged for use with the connector housing 58 comprising a unitary, molded body of electrically insulating plastic material including a number of cavities 122 for receiving the terminals 54B of the terminated wires 54. As can be seen for example in FIGS. 10 and 29, the cavities 122 of the housing 58 are arranged in rows and columns, and in the illustrated arrangement there are fifteen cavities arranged in an X-Y matrix where X equals five and Y equals three. It should be understood that other housing configurations may be used if desired.

As best seen in FIGS. 25–27, the cavities 122 are similar to one another and each includes an entrance portion 124 through which a terminal 54B is inserted together with a reduced diameter neck portion 126 defining oppositely facing locking shoulders for the retention of the terminal 54B within the cavity 122 upon full insertion. A skirt wall 128 is common to all of the cavities 122 in the illustrated arrangement and defines a contact receiving space for enclosing contact portions of the terminals 54B after insertion.

The connector housing 58 is supported in the machine 50 within the nest block assembly 66, and the nest block assembly 66 is supported in turn within the index head assembly 68. In accordance with a feature of the present invention, the index head assembly 68 is mounted on the indexing assembly 70, and the indexing assembly 70 functions automatically to position housing cavities 122 relative to the insertion station 56 in response to loading of terminated wires 54 in order to accept the wires in a predetermined sequence.

Referring more specifically to the structure of the indexing assembly 70, there is provided a first slide member 130 movable relative to the fixed portions of the machine 50 in a side-to-side, or X direction, and a second slide member 132 slidably received in the slide member 130 for movement in the front-to-back, or Y direction. The slide members 130 and 132 are positioned by the electrical and pneumatic circuits 86 and 88 for movement in increments to selected positions corresponding with the rows and columns of cavities 122.

In order slidingly to support the X direction slide member 130, this member is mounted in a slide structure (FIG. 9) including a pair of slide rails 134 and 136 and a pair of end blocks 138 and 140. This slide structure is supported by and fixed to the frame support bar 120. The slide member 130 includes slide recesses 142 (FIG. 5) slidingly receiving the rails 134 and 136.

Figures 7, 8:
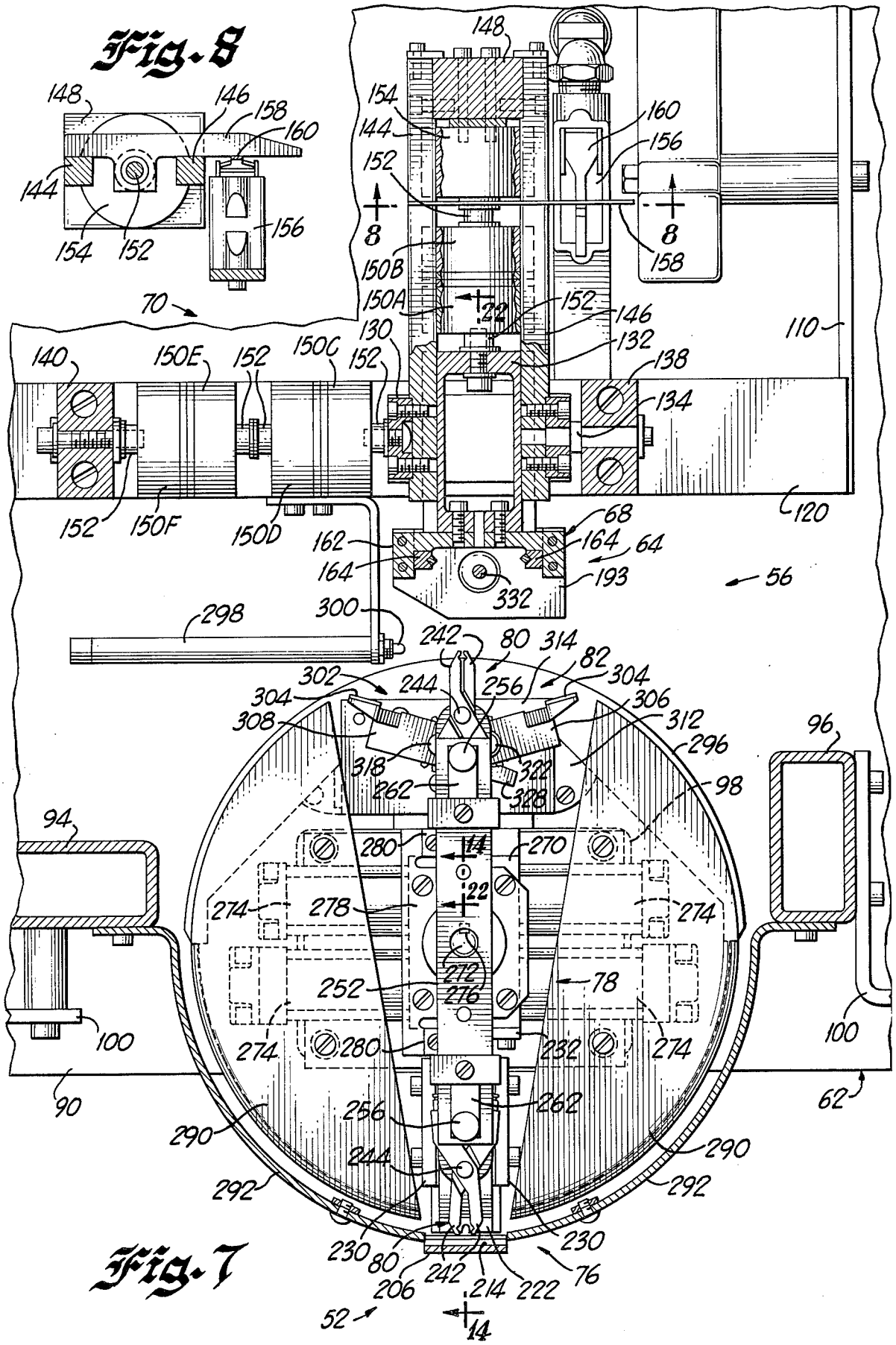
FIG. 7 is a sectional view taken along the line 7—7 of FIG. 5.
FIG. 8 is a sectional view taken along the line 8—8 of FIG. 7 and illustrates the extension sensing switch operating structure associated with the indexing assembly of the machine.

In a similar manner, the Y direction slide member 132 is slidingly supported between a pair of slide rails 144 and 146 joined by a support block 148 (FIG. 7). While the slide structure associated with member 130 is fixed relative to the machine 50, the slide rails 144 and 146 together with block 148 are mounted for movement in the X direction by attachment of the forward ends of rails 144 and 146 to the X direction slide member 130 as best appears in FIG. 7.

In order to move the slide members 130 and 132 in increments of movement, a number of similar pneumatic cylinders 150A–150F are provided. Each of these cylinders includes a housing defining an internal air cylinder, and each housing is provided with grooves at opposed points around its periphery for slidingly mounting the housing relative to the rails 134 and 136 or the rails 144 and 146 (FIGS. 7 and 9). In FIG. 7, each of the cylinders 150A–150F is shown in the fully extended position and it can be seen that each includes an extended piston portion 152 causing outward movement or extension of the slide members 130 and 132 from the relatively fixed end supports 140 and 148, respectively.

More specifically, the cylinders 150A and 150B are interposed between the end support 148 and the slide member 132. By selective pressurization of these cylinders 150A and 150B, the slide member 132 can be positioned in one of three stepped positions along the Y axis, these positions corresponding to location of the housing 58 in positions corresponding to the three rows of cavities 122. Similarly, cylinders 150C–150F are interposed between end support 140 and slide member 130. Selective energization of these cylinders positions the housing 58 selectively in any of five positions corresponding to the five columns of cavities 122 in the housing 58.

Associated with the indexing assembly 70 is an additional pneumatic cylinder 154 mounted between slide rails 144 and 146 and fixed to support block 148. As appears in more detail below, cylinder 154 is pressurized during the insertion operation for moving the connector housing 58 between retracted and extended positions to align the housing with the insertion station 56. The piston member of cylinder 154 is not illustrated in the extended position in the drawings, but upon pressurization of the cylinder 154, the slide member 132 is extended through a distance indicated in broken lines in FIG. 22.

In order to provide an indication of the extension and retraction of the slide member 132 during an insertion operation, an extension sensing switch 156 is mounted adjacent the rail 146 (FIG. 7). The piston of cylinder 154 carries a switch operator 158 engageable with a switch actuating lever 160 when the piston of cylinder 154 is moved between its retracted and extended positions.

Index head assembly 68 is carried by the slide member 132 and thus is movable into selected positions through operation of the indexing assembly 70. Index head assembly 68 includes a main support member or slide retainer 162 fastened to the forwardmost end of the slide member 132 (FIG. 7). A pair of slide structures 164 carried by the slide retainer 162 mount a slide block 166 for vertical sliding movement in the retainer 162 (FIGS. 7 and 10).

Figure 10:
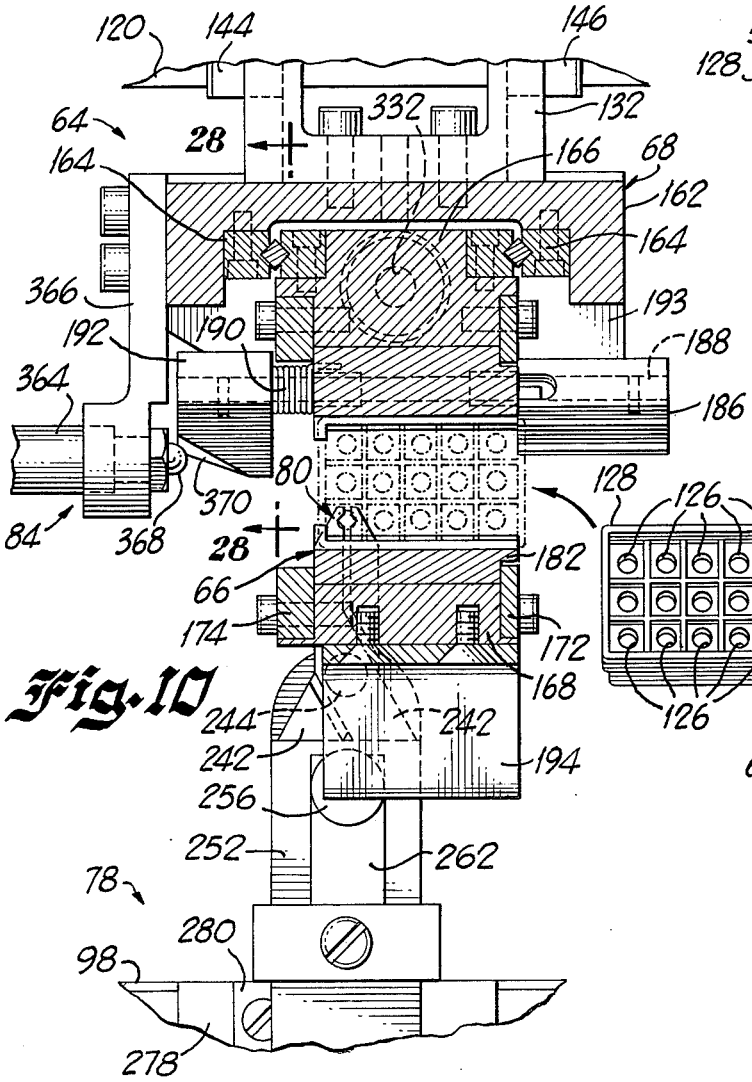
FIG. 10 is a sectional view on an enlarged scale taken along the line 10—10 of FIG. 9.
Figure 11:
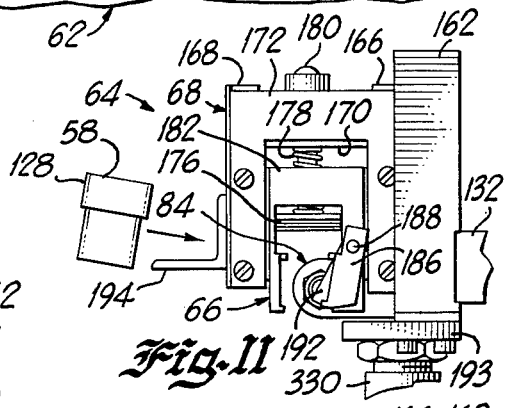
FIG. 11 is a fragmentary enlarged side view, taken from the right side as the machine is viewed in FIG. 2, illustrating the housing support structure prior to mounting of a housing.
Figure 12:
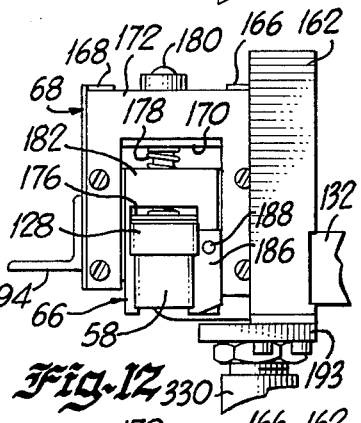
FIG. 12 is a view similar to FIG. 11 illustrating the housing support structure during mounting of a housing.
Figures 22, 23:
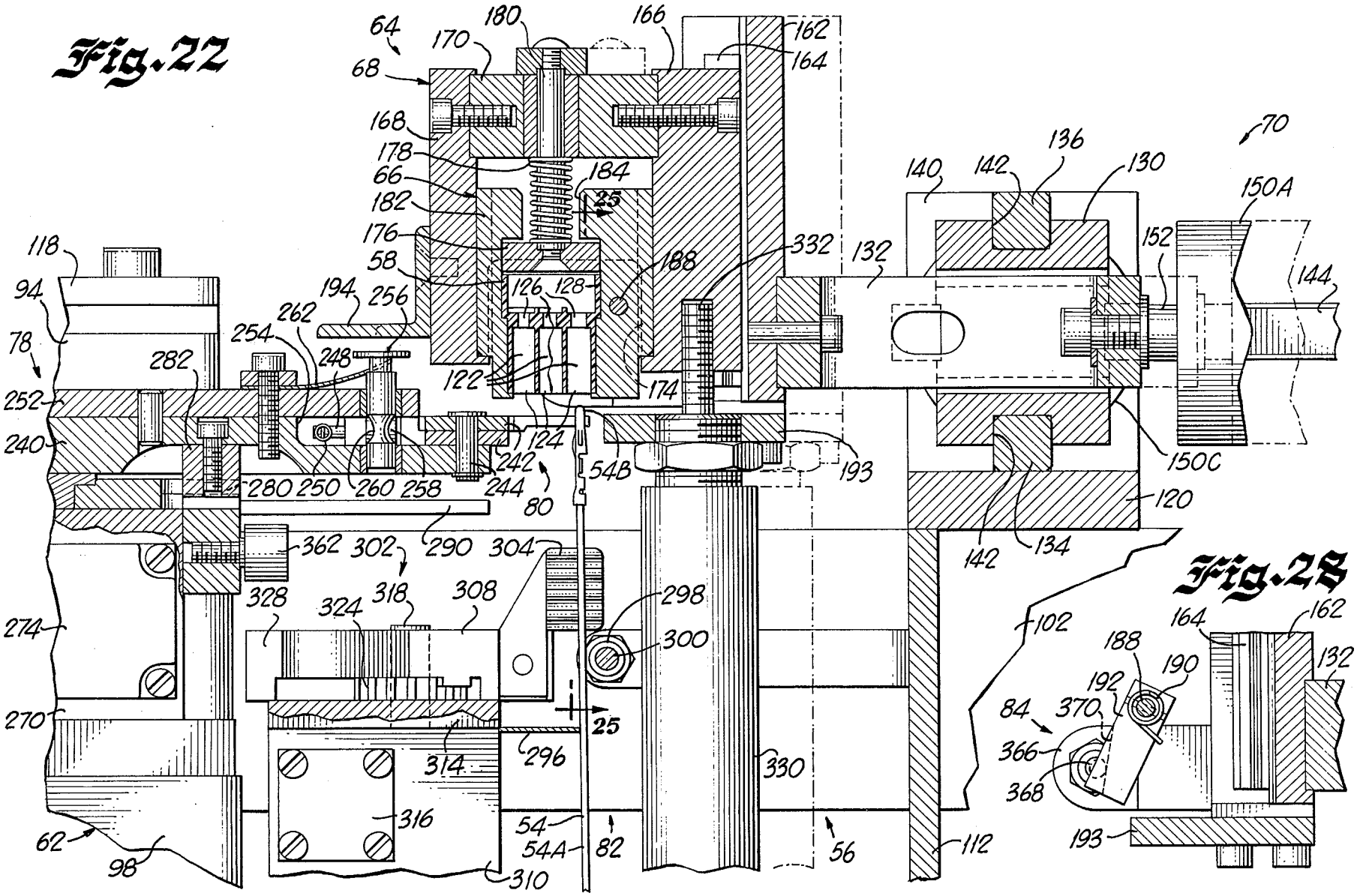
FIG. 22 is a sectional view on an enlarged scale taken along the line 22—22 of FIG. 7 and illustrating the insertion station of the machine prior to an insertion operation.
FIG. 23 is a view similar to FIG. 22 illustrating the insertion station during an insertion operation.
Figure 24:
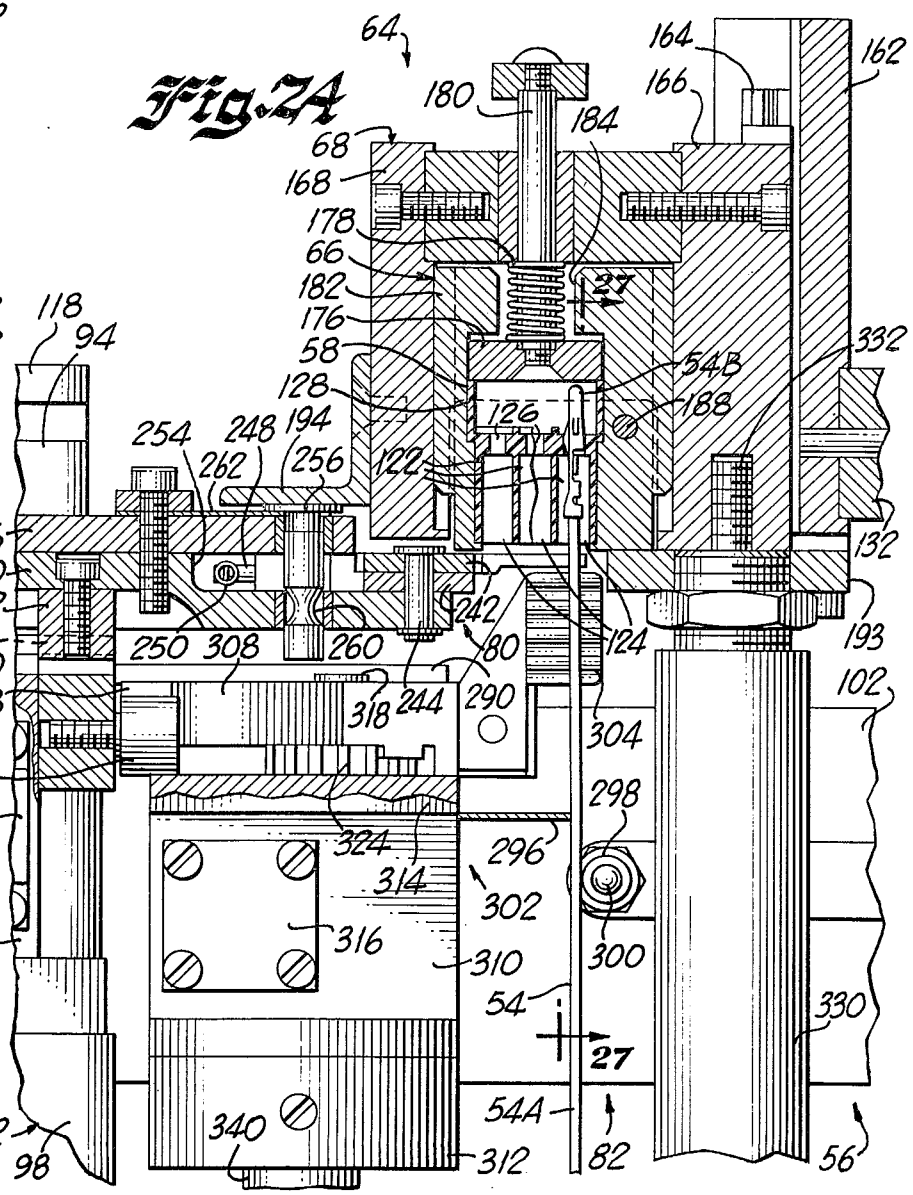
FIG. 24 is a view similar to FIG. 22 illustrating the insertion station at the completion of an insertion operation.
Figure 23:
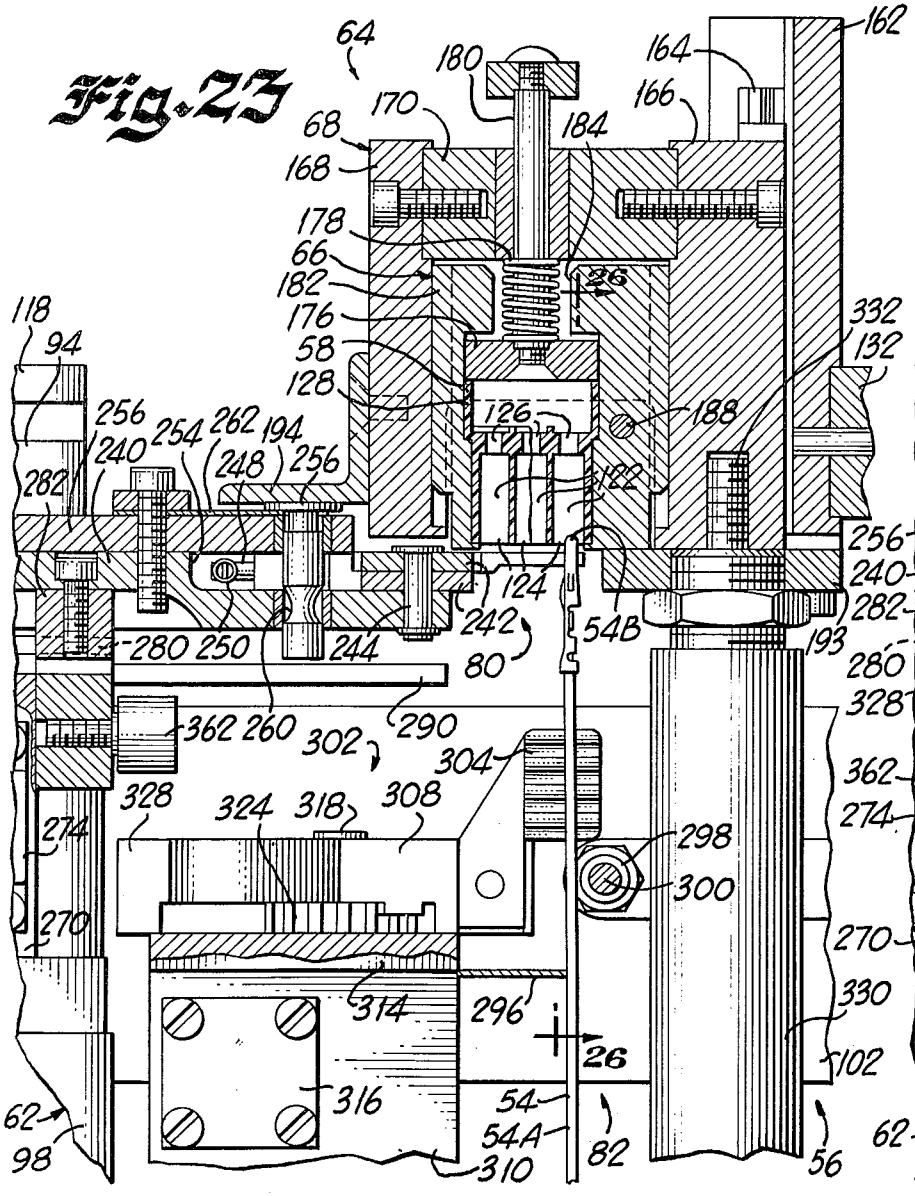

As can best be seen with reference to FIGS. 22 and 10, the index head assembly forms a cavity or housing for slidably mounting the nest block assembly 66, this cavity or housing being formed by the slide block 166, by an end block 168 opposite the slide block 166, by an upper support member 170, and by forward and rear retainer plates 172 and 174. Plate 172 is removable in order to permit the mounting and replacing of the nest block assembly 66.

A pressure shoe 176 is biased in a downward direction by means of a spring 178 surrounding a slide pin 180 in order frictionally to position housing 58 within the nest block assembly 66 and to permit vertical sliding movement of the nest block assembly 66 within index head assembly 68 during an insertion operation.

In accordance with the invention, the nest block assembly 66 is easily removable from the index head assembly 68 so that different nest block assemblies may be provided for readily accommodating housings of different sizes and configurations. As a result of this approach, when setting up the machine 50 for different assembly operations, it is not necessary materially to alter the structure of the machine, but simply to reprogram the indexing assembly 70, replace the nest block assembly 66, and to arrange the terminated wires 54 in bin assembly 72.

Nest block assembly 66 includes a nest block 182 of generally U-shaped configuration (FIG. 5) including opposed side walls having a configuration designed for capturing the connector housing 58 (FIG. 22). The bight portion or top wall of the nest block 182 is provided with a slot 184 receiving the spring 178 and pin 180 when the nest block 182 is slid into position within the index head assembly 68. This positions the pressure shoe 176 between the side walls of the nest block 182. As appears in FIG. 10, the side walls of nest block 182 are shaped to permit vertical sliding movement of the nest block assembly 66 within the index head assembly 68, and the spring 178 urges the nest block 182 to its lower position illustrated in FIG. 22.

Figure 13:
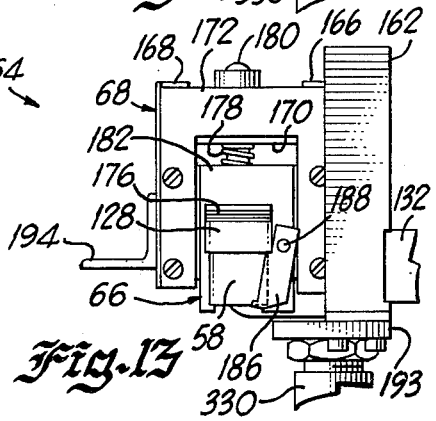
FIG. 13 is a view similar to FIG. 11 illustrating the housing support structure after mounting of a housing.

In order to retain the housing 58 in position within the nest block assembly 66, a latch plate 186 is provided. As can best be seen in FIG. 10, the latch plate 186 is carried by a pin 188 rotatably mounted in the nest block 182. A spring 190 resiliently biases the latch plate 186 to a position overlying the housing 58 so that the housing cannot inadvertently be ejected from the assembly 66. However, the latch plate 186 can be provided against the force of spring 190 from the position of FIG. 11 to the position of FIG. 12 for the mounting and removal of housing 58 from the nest block assembly 66. The housing 58 is inserted manually, and the plate 186 can be pivoted easily out of the way during insertion of the housing. After insertion of the housing, as illustrated in FIG. 13, the latch plate returns to its position blocking removal of the housing 58. The housing is inserted freely because a space is provided between pressure shoe 176 and the housing.

In order to provide for automatic ejection of the housing 58 after completion of a sequence of insertion operations, a cam block 192 is also attached to the pin 188. Rotation of the block 192 by the housing ejection assembly 184 as described below results in movement of the latch plate 186 from the latching position illustrated in FIG. 11 to the open position illustrated in FIG. 12.

As indicated above, the slide block 166 is mounted for vertical sliding movement relative to the slide retainer 162. Similarly, the nest block 182 is slidably mounted between the slide block 166 and the end block 168. A stop plate 193 is attached to the lower end of the slide retainer 162 to limit downward movement of the nest block 182 during downward movement of the slide block 166, as described in more detail below. Also associated with the index head assembly 68 is an actuating arm 194 cooperating with the transfer assembly 78 in a manner described below.

BIN STRUCTURE AND LOADING STATION

In order to provide for rapid and convenient operation of the machine, the bin structure is arranged for convenient feeding of terminated wires 54 into the loading station 52. More specifically, the bin structure 72 includes a number of individual bins 200 located convenient to the operator's left hand and an additional group of bins 202 convenient to the operator's right hand. The bins 200 and 202 are supported in clusters upon the support brackets 100 are are well within the reach of an operator stationed at the front of the machine 50.

In setting up the machine 50 for producing a number of similar connector assemblies, groups of terminated wires 54 are loaded into the bins 200 and 202. Each bin contains a number of idential terminated wires 54 intended to be inserted in the same position in a series of housings 58. As indicated above, the indexing assembly 70 positions the housing 58 in sequence to locate the cavities 122 sequentially in alignment with the insertion station 56. The bins 200 and 202 are loaded such that the first wire of each harness 60 is taken from a bin 200 on the left side, the second wire is taken from a bin on the right side, the third wire is taken from a bin 200 on the left side, and so forth. In this manner, the operator is able to load the machine with alternate hands in a rhythmic mode. It has been found that after a short period of time, an operator can load terminated wires 54 into the loading station 52 without looking at the bins 200 and 202.

Loading of a terminated wire 54 at the loading station 52 initiates a cycle of operation of the machine 50 wherein the terminated wire is gripped by a transfer gripping assembly 80, is transferred to the insertion station 52 by the transfer assembly 78 and is inserted into a housing 58 as positioned by the indexing assembly 70 by means of the insertion assembly 82. The start switch assembly 74 is provided for sensing the loading of a terminated wire 54 and for providing a control signal to the electrical control circuit 86 for initiating this sequence of events.

More specifically, the start switch assembly 74 includes a switch 204 (FIG. 14) carried by a switch mounting bracket 206 located at the front of the machine 50 adjacent the loading station 52. Bracket 206 is carried by a mounting plate 208 in turn supported on the front support plate 188 as best seen in FIG. 1.

In order to operate switch 204 in response to loading of a terminated wire 54, there is provided an actuating lever 210 pivotally mounted on a lever mounting bracket 212 also supported by the plate 208. The range of movement of lever 210 is limited by positioning the free end of the lever within a guide notch 214 disposed at the inner surface of the switch mounting bracket 206. An adjustment screw 216 carried by the lever 210 operates the start switch 204 when a terminated wire 54 at the loading station 52 is pushed upwardly against lever 210.

A desirable visual and tactile target area is formed at the loading station 52 by the configuration of the switch mounting bracket 206 and by the provision of the loading guide assembly 76. With regard first to the switch mounting bracket 206, as appears in FIGS. 2 and 14, this bracket includes a downwardly extending flange portion 218. A generally semi-circular recess 220 is formed in the flange 218, and the operator naturally inserts a terminated wire 54 into the center of recess 220.

With reference now to the loading guide assembly 76, this assembly includes a slidably mounted guide member 222 having a generally cone-shaped guide recess 224 formed in its forward end. A terminated wire 54 inserted through the recess 222 and against the recess 224 is easily and naturally guided in an upward direction into the proper loading position against the switch actuating lever 210.

Figure 19:
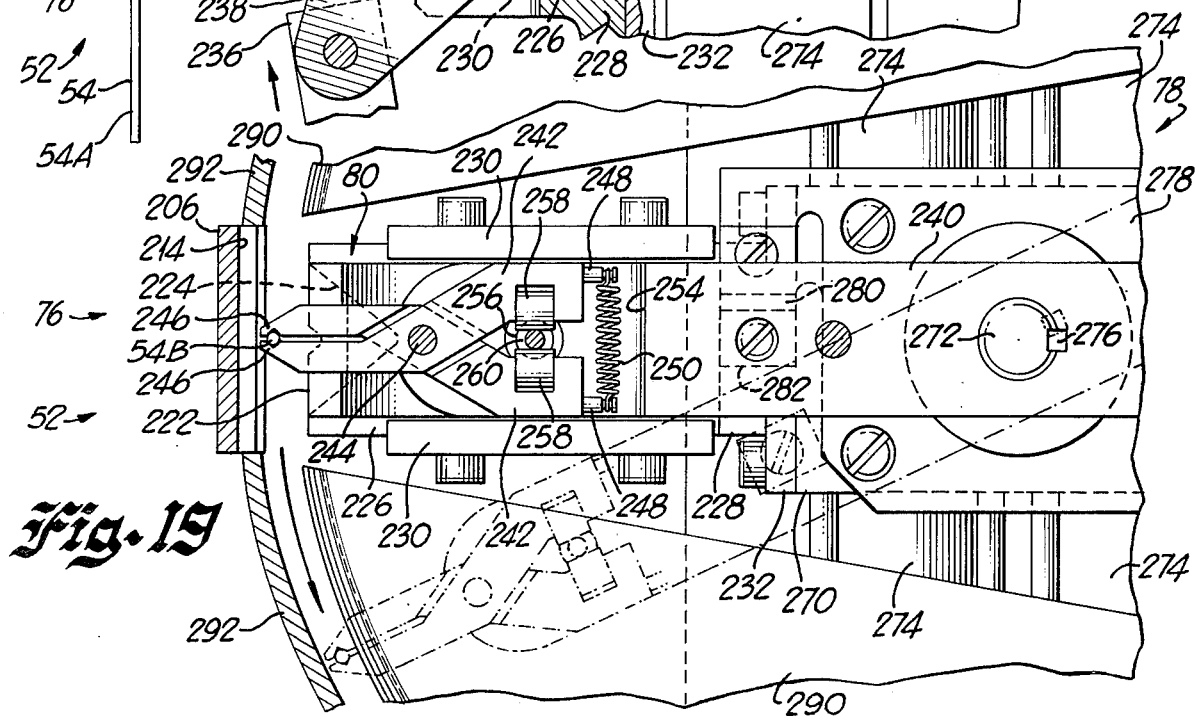
FIG. 19 is a view similar to FIG. 17 taken along the line 19—19 of FIG. 18.

In order to permit movement of a loaded terminated wire 54 from the loading station 52, the guide member 222 is mounted to be retracted by a sliding movement out of the path of movement of the terminated wire 54. Member 222 includes a rearwardly extending slide portion 226 captured in a slideway defined by a slide base member 228 and a pair of side plates 230. Base member 228 supports the plates 230 and is in turn supported on a mounting plate 232 fastened to a fixed supporting structure carried at the top of the center support column 98. Due to this sliding mounting, the guide member 222 can move between a guide position (FIGS. 14 and 17) and a retracted position (FIGS. 18 and 19).

Retraction of the guide member 222 takes place as a result of operation of the start switch 204. As described in more detail below, operation of switch 204 results in pressurization of a pneumatic cylinder 234 carried by the center support column 98 (see FIG. 5). A piston 235 associated with cylinder 234 is coupled by means of a clevis member 236 to a cam lever 238. Lever 238 is pivotally mounted to slide base member 228 and is interconnected with the slide portion 226 of guide member 222 by a pin and slot connection. From a comparison of FIGS. 14 and 18, it can be seen that extension of piston 235 results in rotation of the lever 238 and in retraction of the guide member 222.

Transfer Assembly And Transfer Gripping Assemblies

In accordance with a feature of the present invention, the transfer assembly 78 includes two transfer gripping assemblies 80 arranged so that one gripping assembly 80 is located at the loading station 52 while the other is located at the insertion station 56. Consequently, no delay is encountered between the time that one terminated wire 54 is inserted into a connector housing 58 at the insertion station 56 and the loading of the next terminated wire at the loading station 52.

In general, the transfer assembly 78 includes a transfer arm 240 mounted for pivotal or rotational movement about an axis located between the insertion and loading stations 56 and 52. The arm is controlled for oscillatory movement in alternate directions through 180° of rotation. Consequently, and in accordance with another feature of the invention, the gripping assemblies 80 disposed on opposite ends of the arm 240 move in opposite directions away from the loading station 52. Recalling that terminated wires 54 are loaded into the loading station 52 with alternate hands of the operator, the transfer assembly 78 pulls each wire away from the palm of the operator's hand and through the operator's fingers in opposite directions.

Each end of the transfer arm 240 is provided with a gripping assembly 80, and these assemblies are identical to one another. As best seen in FIGS. 14–19, each gripping assembly includes a similar pair of gripping arms 242 mounted for opening and closing movement about a common pivot pin 244. The outward ends of the arms 242 define a set of gripping jaws 246 movable between an open position (FIG. 17) wherein a terminated wire 54 can be inserted between the jaws and a closed position (FIG. 19) wherein the terminal 54B of the terminated wire 54 is held between the jaws. Each arm 242 is provided with a spring retaining extension 248, and a spring 250 held in tension between these extensions resiliently biases the jaws 246 toward the closed position.

As best appears in FIGS. 14 and 18, the transfer arm 240 carries a top plate 252, and the inner portions of the arms together with the extensions 248 and the spring 250 are received in a slot 254 defined between the plate 252 and the arm 240. An actuating pin 256 mounted for sliding movement in the plate 252 and in the arm 240 operates mechanically to move the jaws 246 between the open and closed positions. Each arm 242 carries a roller 258, and the pin 256 is sandwiched between the rollers 258.

In a lower position of the pin illustrated in FIG. 14, the diameter of the pin is such as to hold the jaws 246 in their open position against the closing force provided by the spring 250. When the pin 256 is moved from the lower position of FIG. 14 to an upper position illustrated in FIG. 18, a groove 260 in the pin 256 is received between rollers 258 so that the jaws 246 move to the closed position. Stability of the pin 256 is augmented by the provision of a leaf spring 262 engageable with the head of the pin.

Each transfer gripping assembly 80 arrives at the loading station 52 with its jaws 246 in the open position ready to receive an inserted terminated wire 54. Upon loading of the wire and in response to operation of the start switch 204, the jaws are moved to the closed position. This is accomplished by upward movement of the pin 256 by means of the cam lever 238. More specifically, the lever 238 includes a cam surface 264 engageable with the bottom of the pin 256 so that, simultaneously with the retraction of the sliding guide member 222, the jaws 246 are closed upon the terminal portion 54B of the terminated wire 54.

In order to oscillate the transfer arm 240 between positions, the transfer assembly 78 includes a rotary actuator 270. The actuator includes an output shaft 272 adapted to be rotated throughout approximately 180° in alternate directions in response to the selective pressurization of various ones of a group of air cylinders 274 associated with the device. As described in more detail below, actuation of the start switch 204 also results in operation of the rotary actuator 270 to commence movement of the transfer gripping assembly 80 from the loading station along a circular path toward the insertion station. The commencement of this movement is indicated in broken lines in FIG. 19.

Drive shaft 272 of the rotary actuator 270 is coupled to the center of the transfer arm 240 by means of a drive key 274. In order to position the arm 240 precisely in its two alternate positions, a stop plate 278 is attached to the top of the rotary actuator 270. A pair of stop blocks 280 are fastened to the stop plate (FIGS. 17–19) at two opposed locations relative to the shaft 272. A stop member 282 carried upon the underside of transfer arm 240 engages the blocks 280 in the two alternate positions of the transfer arm 240.

Figures 5, 6:
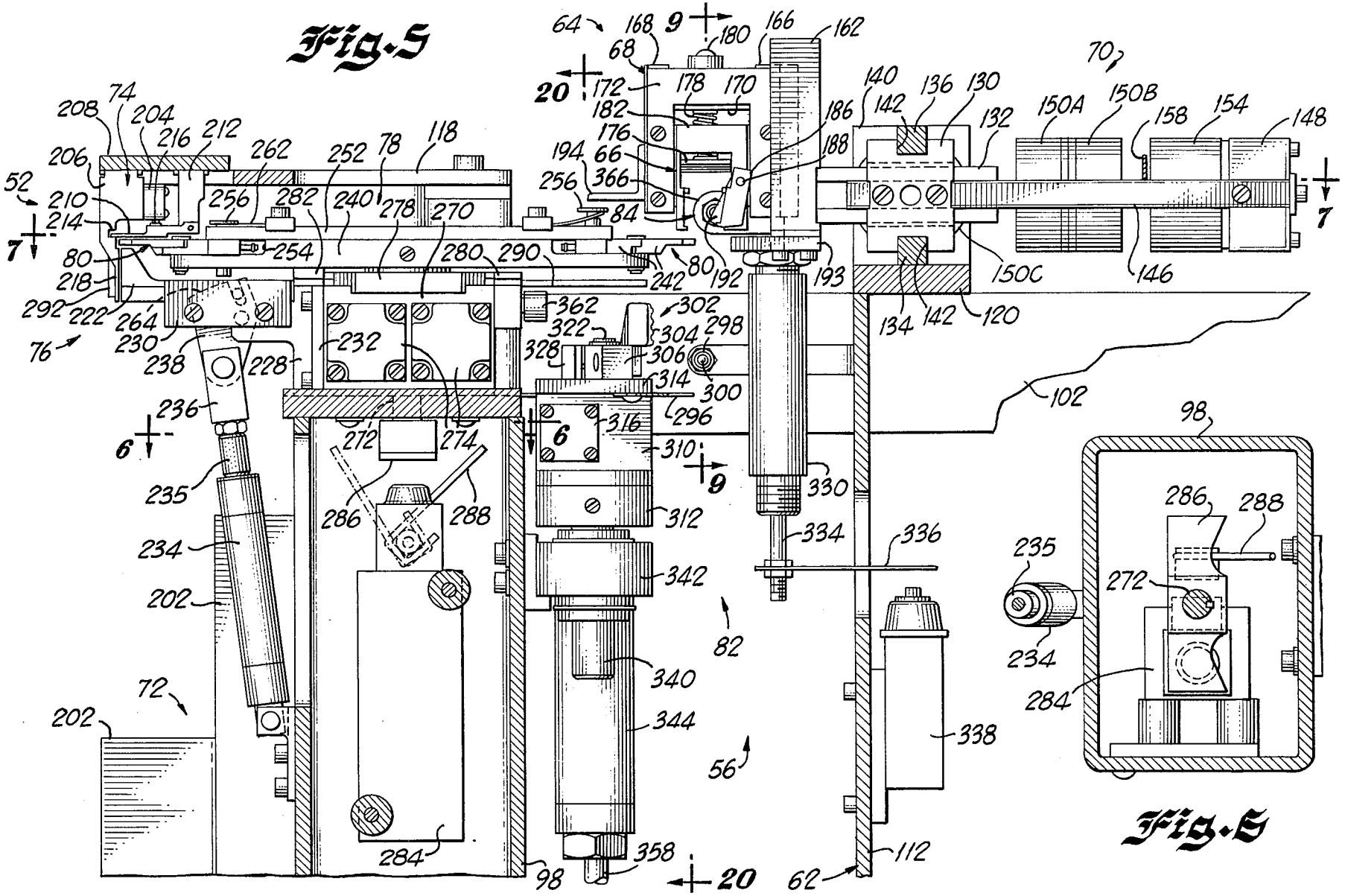
FIG. 5 is a partial sectional view on an enlarged scale taken along the line 5—5 of FIG. 1.
FIG. 6 is a sectional view on an enlarged scale taken along the line 6—6 of FIG. 5 and illustrates the transfer sensing switch operating mechanism associated with the transfer assembly of the machine.

Indication of operation of the transfer assembly 78 is provided by means of a transfer assembly sensing switch 284 best illustrated in FIGS. 5 and 6. The switch 284 is mounted within the central support column 98 below the rotary actuator 270. The actuator output shaft 272 extends downwardly toward the switch 284 and carries a switch actuator arm 286. The switch is operated between two alternate positions by a bistable operating assembly including an operating lever 288 movable in an overcenter fashion between two positions illustrated respectively in broken lines and full lines in FIG. 5. As the rotary actuator operates to move the transfer arm 240 between positions, the switch actuator arm 286 also moves through 180° of rotation to pivot the lever 288 between its positions. The geometry of the arrangement is such that during each operation of the rotary actuator 270, the switch 284 is operated near the end of the range of movement of the transfer arm 240.

During operation of the transfer assembly 78, the terminal portion 54B of the terminated wire 54 is gripped in one of the gripping assemblies 80 and is moved rapidly through a circular path from the loading station 52 to the insertion station 56. During this motion, the wire segment 54A of the terminated wire 54 hangs from the gripping assembly 80. It will be appreciated that many lengths and thicknesses of wire may be moved, and that the centrifugal force applied to the wire during transfer might cause an undesirable bending of the wire portion 54A. In order to prevent such bending and to guide the wire during transfer, there are provided a pair of inner guide plates 290 (FIG. 1), and a pair of outer guide skirts 292. Plates 290 and skirts 292 define generally circular paths for movement of the wire segments 54A. It will be appreciated that if desired, the skirts 292 may extend substantially further down than illustrated in the drawings. The portion of the path of movement for wires 54A adjacent the insertion station 56 is defined by a rear guide plate 296 appearing in FIGS. 1, 2 and 21 of the drawings.

After one or more terminated wires 54 have been inserted into the connector housing 58, it is desirable to prevent tangling of a wire being transported by the transfer assembly 78 with wires depending from the housing 58 contained in the housing support structure 64. In order to prevent this problem, the machine 50 is provided with a wire guide device in the form of a pneumatic cylinder 298. As appears in FIGS. 21, the cylinder 298 includes a piston 300 movable between a retracted position and an extended position. Wire guide piston 300 is extended during motion of the transfer arm 240 to prevent tangling of a transferred wire with previously inserted wires.

After insertion, the piston 300 is retracted so that the most recently inserted wire is not prevented from moving as the housing 58 is moved from its extended insertion position to its retracted position between insertion operations. Piston 300 also prevents previously inserted terminated wires 54 from moving into the insertion station 56 during extension of the housing 58 over the insertion station. It will be understood that piston 300 may be shaped to provide more spacing, or if desired more than one wire guide cylinder may be provided.

INSERTION ASSEMBLY

An insertion operation at the insertion station 56 is initiated by operation of the transfer sensing switch 284 as a terminated wire 54 reaches the insertion station. During the insertion operation, the terminated wire 54 is gripped by an insertion gripping assembly generally designated as 302, and the connector housing positioned by the indexing assembly 70 is moved into alignment with the terminated wire 54. The transfer gripping assembly 80 is released, and the housing 58 and terminated wire 54 are moved toward one another to latch the terminal portion 54B in its home position with a predetermined housing cavity 122.

With reference to FIGS. 5 and 20–22, the insertion gripping assembly 302 includes a pair of gripping jaws 304 having serrated surfaces adapted to grasp the wire portion 54A of a terminated wire 54 firmly without deformation and without damage to the wire insulation. The jaws 304 are carried on a pair of rotatably mounted arms 306 and 308. The arms 306 and 308 are mounted for conjoint rotational movement from the open positions illustrated in broken lines in FIG 21 to the closed positions illustrated in full lines in FIG. 21. In the open position, the jaws 304 are clear of the path of wire travel.

In order to control movement of the arms 306 and 308, there is provided a rotary actuator 310 mounted between a support plate 312 and a mounting plate 314. Actuator 310 is of conventional construction and includes a pair of pneumatic cylinders 316 selectively pressurized to produce rotary motion of an output shaft 318 in alternate directions through somewhat less than 90° of rotation. Arm 308 is fixed to the output shaft 318 by means of a key 320, and arm 306 is mounted for pivotal motion on a shaft 322. Gears 324 and 326 carried by the shafts 318 and 322 mesh so that rotation of the shaft 318 and its arm 308 results in simultaneous and reverse rotation of the shaft 322 and its arm 306. Arm 308 includes an extension 328 engageable with arm 306 to limit the opening movement of the gripping jaws 304.

With reference to FIG. 21, it can be seen that the transfer gripping assembly 80 is illustrated in broken lines in a position slightly displaced from the insertion assembly. During movement of the transfer assembly 78, when the gripping assembly 80 reaches this position, the switch 284 is operated. At this time, the gripping jaws 304 are positioned as illustrated in broken lines in FIG. 21. In response to operation of the switch 284, the jaws begin to move to the closed position. After the terminated wire 54 reaches its final position, the jaws 304 complete their closing movement firmly to grasp the wire portion 54A.

Also in response to operation of the transfer sensing switch 284, and during closing movement of the insertion gripping assembly 304, the housing 58 is positioned for an insertion operation. This positioning is carried out by means of pressurization of air cylinder 154 associated with the indexing assembly 70. When cylinder 154 is pressurized, the slide member 132 and thus the index head assembly 68 is extended in the Y direction so that a predetermined housing cavity 122, as selected by the indexing assembly 70, is aligned with the terminated wire 54 held by the insertion gripping assembly 302. It should be noted that the wire guide piston 300 is extended at this point to prevent tangling between the terminated wire 54 to be inserted and terminated wires 54 which may have been previously inserted, and to prevent the jaws 304 from closing on a previously inserted wire.

In response to movement of the index head assembly 68 by cylinder 154, the extension sensing switch 156 is operated by means of the switch operator 158 and the switch actuating lever 160 (FIG. 7). Actuation of switch 156 results in downward movement of the index head assembly 68 and of the nest block assembly 66 and housing 58 carried thereby.

In order to produce this downward movement, there is provided a first insertion air cylinder 330 carried by the stop plate 193 of the index head assembly 68. CYlinder 330 includes an upwardly extending piston portion 332 (FIG. 22) attached to the slide block 166 associated with the index head assembly 68. When cylinder 330 is pressurized, the slide block 166 moves downwardly in slide structures 164 to lower the connector housing 58 and the remaining structure of the index head assembly.

Nest block assembly 66 is mounted for sliding movement relative to the index head assembly 68. As can be seen from a comparison of FIG. 22 and FIG. 23, during downward movement of the slide block 166, the nest block 182 engages the stop plate 193. Consequently, the nest block 182 moves through a limited downward movement while the index head assembly continues through a longer range of movement.

During the limited range of movement of the nest block assembly 66 and the connector housing 58, the terminated wire 54 and housing 58 move relative to one another from the positions illustrated in FIGS. 22 and 25 to the positions illustrated in FIGS. 23 and 26. Consequently, and in accordance with a feature of the invention, the tip of terminal 54B is started into the housing cavity 122 while the terminated wire is held in a precise position by the transfer gripping assembly 80 and also by the insertion gripping assembly 302. This provides a desirable degree of precision in assuring that the terminal 54B is aligned properly with the desired housing cavity 122.

As indicated above, the index head assembly 68 continues its downward movement after the nest block assembly 66 is stopped by the stop plate 193. During this continued downward movement, the actuating arm 194 (FIG. 22) strikes the top of the actuating pin 256 associated with the transfer gripping assembly 80. The pin 256 is moved downwardly resulting in movement of the groove 260 from between the rollers 258. As a result, the gripping arms 242 are separated against the force of the spring 250 to open the jaws 246. The movement of the jaws 246 to the open position can be seen with reference to FIG. 27. After nest block 182 reaches the stop plate 193, the pressurre shoe 176 engages the connector housing 58 and holds it firmly in place as spring 178 is compressed.

In order to provide an indication of the operation of the first insertion air cylinder 330, there is provided a downwardly directed piston extension 334 carrying a switch actuating arm 336. A first insertion sensing switch 338 is supported upon wall 112 and is operated by the actuating arm 336 when piston extension 334 reaches its lowermost position.

Insertion of terminal 54B into housing 58 is completed in response to operation of the first insertion sensing switch 338. In order to complete this insertion, the insertion gripping assembly 302 is mounted for vertical sliding movement by means of a pair of slide shafts 340 (FIGS. 5 and 20) slidably mounted in a bearing plate 342 attached to the center support column 98. After release of the transfer gripping assembly 80, a second insertion air cylinder 334 supported by bearing plate 342 is pressurized to lift the insertion gripping assembly. Cylinder 344 includes a piston 346 attached as seen in FIG. 20 to the support plate 312 of the insertion gripping assembly 302.

When the second insertion air cylinder 344 is pressurized, the gripping jaws 304 move upwardly from the position shown in FIGS. 23 and 26 to the position shown in FIG.S 24 and 27. Consequently, the terminal 54B moves from its slightly inserted position of FIG. 26 to the fully inserted position of FIG. 27.

It should be understood that the machine 50 of the present invention may be used with terminals of many different types. In the illustrated arrangement, the terminal 54B comprises a male pin terminal of the type described in detail in U.S. Pat. No. 3,178,673 - Krehbiel. In general, as best illustrated in FIGS. 25–27, the terminal 54B includes a wire crimp structure 348 for attachment of the terminal 54B to an end of wire segment 54A from which the insulation has been stripped. Terminal 54B also includes a generally cylindrical pin contact portion 350 at its leading end and adapted to be located in the contact receiving portion of housing 58 defined by skirt wall 128 after insertion of the terminated wire 54. In order to retain the terminal 54B securely in place after full insertion, the terminal includes a locking structure including a pair of resiliently compressible lockiing tangs 352 and a spaced pair of locking projections 354. As the terminal 54B moves relative to the housing 58 from the position illustrated in FIG. 26 to the position illustrated in FIG. 27, the tangs 352 are radially compressed as they move through the neck portion 126 of the cavity 122. Upon full insertion, the projections 354 prevent overinsertion, and the tangs 352 move resiliently outward to prevent inadvertent withdrawal of the terminal 54B.

Figure 3:
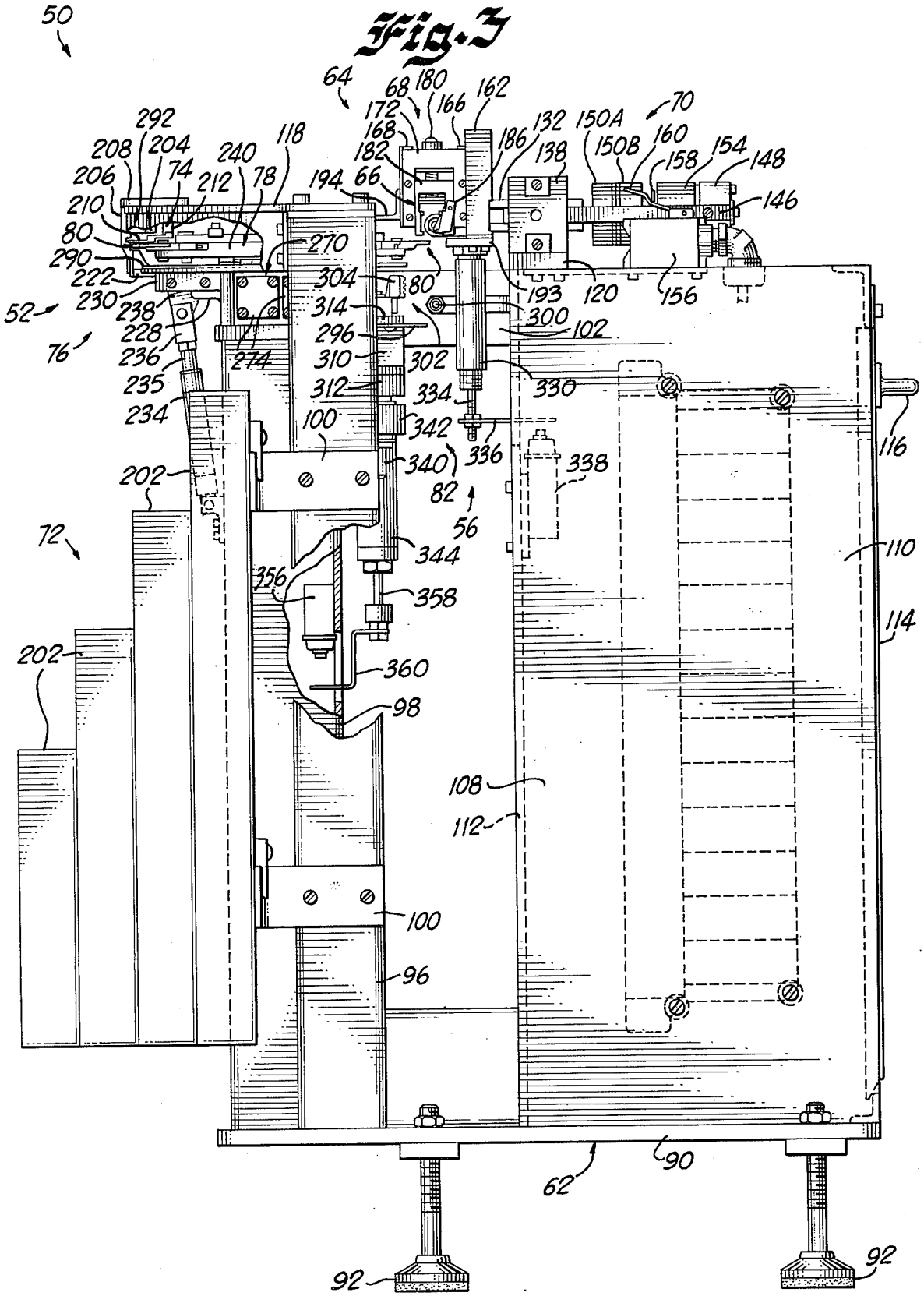
FIG. 3 is a side view of the machine, illustrating the right side as the machine is viewed in FIG. 2.

In order to provide an indication of the completion of an insertion operation, there is provided a second insertion sensing switch 356 supported within the central support column 98 and illustrated in FIG. 3 of the drawings. A downwardly extending piston extension 358 of the second insertion air cylinder 344 carries a switch actuating arm 360 for operating switch 356 in response to movement of the insertion gripping assembly 302 through its full range of movement. The proper degree of insertion is achieved by limiting the range of movement of the piston of the insertion cylinder 344.

After insertion and in response to operating of the second insertion sensing switch 356, the insertion gripping jaws 304 are opened by actuation of the rotary actuator 310. At this time, the extension 328 of arm 308 is aligned with stop roller 362, and the jaws open only slightly so as not to interfere with previously inserted wires 54. Full opening takes place when the insertion gripping assembly 302 descends to its initial position.

Also in response to operation of switch 356, the air cylinder 154 is returned to its initial position thus retracting the index head assembly from the insertion station 56. As the sensing switch 156 is released, cylinder 330 is operated to raise the housing support structure 64 and the housing 58.

When switch 338 is released during upward motion of the housing support structure 64, the second insertion air cylinder 344 is operated to lower the insertion gripping assembly 302 to its initial position ready to receive another terminated wire 54 from the transfer assembly 78. Jaws 304 open fully when extension 328 clears the stop roller 362. In response to performance of an insertion operation, the indexing assembly 70 is controlled by circuits 86 and 88 as described below to position the sequentially next cavity 122 for alignment with the insertion station 56.

When all of the terminated wires 54 associated with a single housing 58 have been inserted in the proper position by the machine 50, the housing ejection assembly 84 operates. This assembly includes an ejection pneumatic cylinder 364 supported on a bracket 366 attached to the slide retainer 162 of the index head assembly 68. FOllowing the last insertion operation, cylinder 364 is pressurized and its piston 368 is extended into engagement with a cam surface 370 formed on the cam block 192 (FIG. 29). As a result the cam block 192 rotates as does the latch plate 186 by virtue of the connecting pin 188.

Further movement of the piston 386 causes it to engage the housing 58 of the completed wiring harness or similar assembly 60 and to eject it past the latch plate 186 and out of the housing support structure 64. A suitable chute or receptacle may be provided for receiving housings 58 discharged from the machine 50.

OPERATION; ELECTRICAL AND PNEUMATIC CONTROL CIRCUITS

Figure 30:
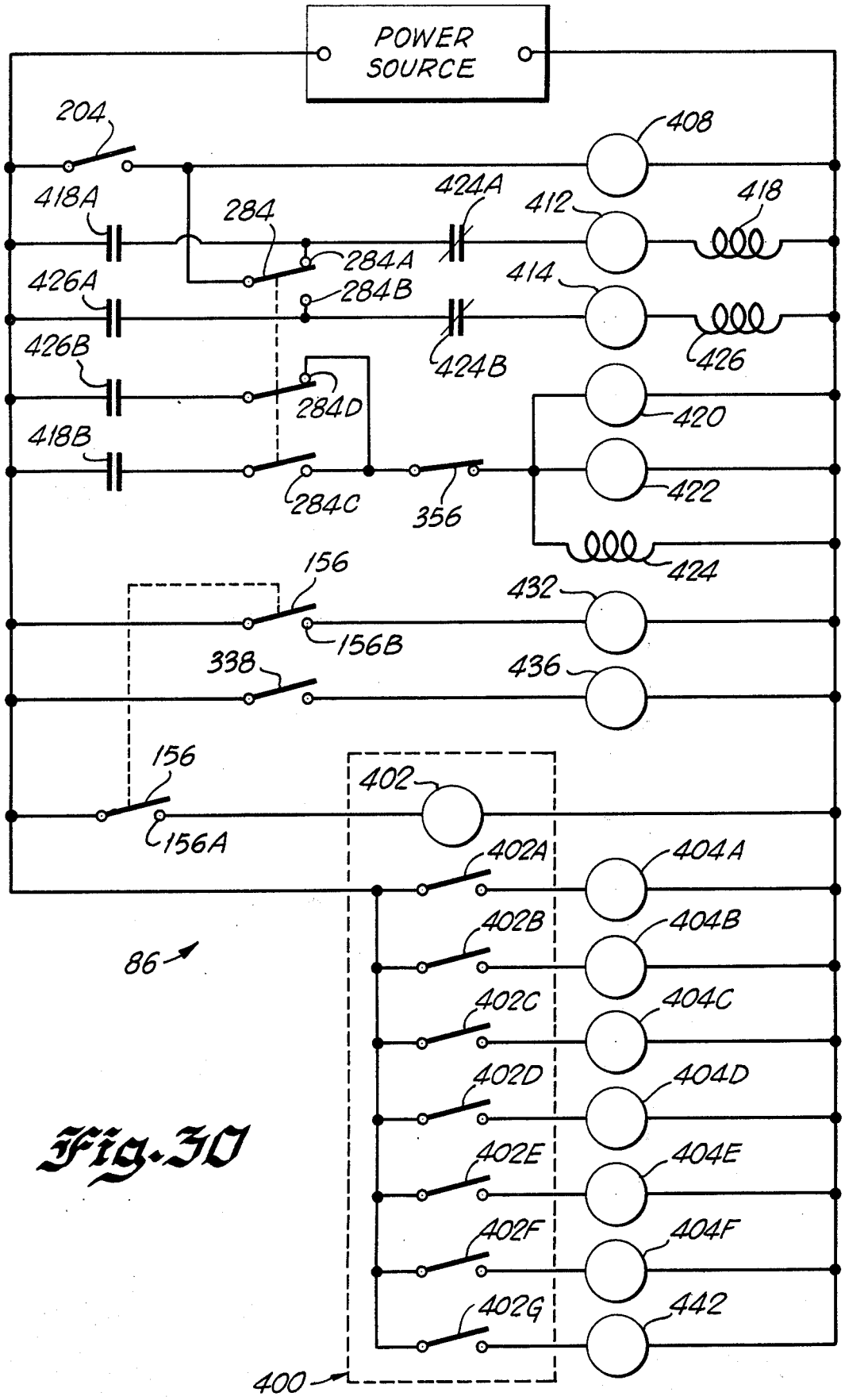
FIG. 30 is a schematic diagram of portions of an electrical control circuit of the machine.
Figure 31:
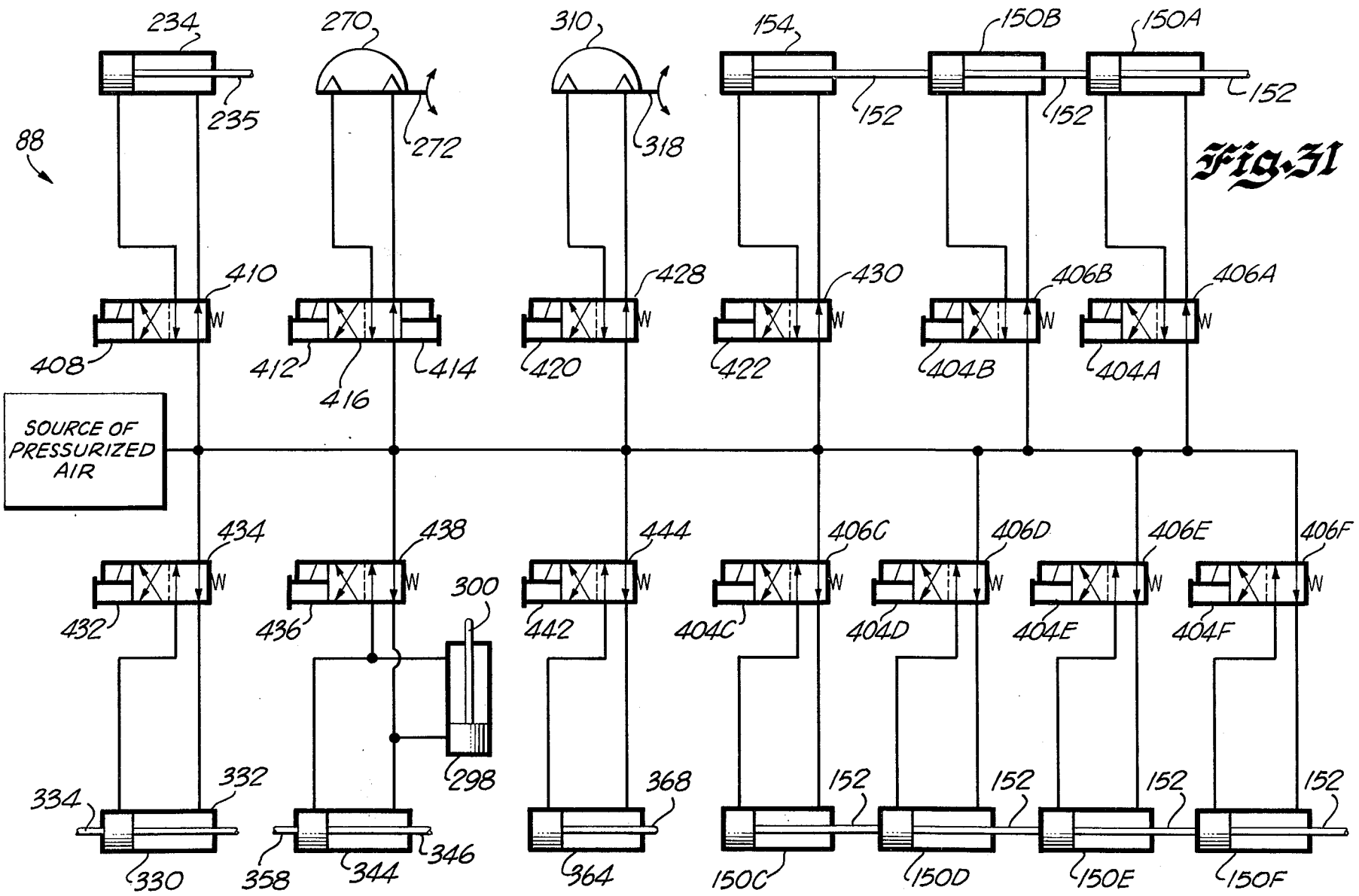
FIG. 31 is a schematic diagram of portions of a pneumatic control circuit of the machine.

Referring now to FIGS. 30 and 31, the electrical and pneumatic control circuits 86 and 88 are illustrated in somewhat simplified and schematic form. These circuits are described below in connection with a description of the operation of the machine 50.

In order to control the operation of the indexing assembly 70 and thus the position of the housing 58, the electrical circuit 86 illustrated in FIG. 30 includes a programmer 400. This programmer is illustrated only schematically, and may comprise any one of a number of types well known to those skilled in the art. As illustrated, programmer 400 includes a programmer solenoid 402 mechanically interrelated with a number of programmer switch contacts designated as 402A–402G. In the illustrated arrangement, the programmer 400 operates in sequence throughout a series of operations, and each operation is caused by first energizing solenoid 402 to cock the programmer and then by deenergizing the solenoid 402 to trigger the programmer.

Each of the programmer contacts 402–402F is connected in series across the power supply with one of a number of solenoids 404A–404F. In FIG. 31, it can be seen that each solenoid 404A–404F is connected in controlling relation to one of a number of pneumatic control valves 406A–406F connected in controlling relation between a source of pressurized air and the indexing cylinders 150A–150F. Each valve 406A–406F is spring biased to a position wherein the piston of the corresponding one of the cylinders 150A–150F is retracted. Energization of any one of the solenoids 404A–404F results in movement of the corresponding valve to its alternate position thereby to extend the piston of the corresponding cylinder.

In the illustrated arrangement, the programmer 400 is arranged so that at the beginning of a sequence of insertion operations for a given connector housing 58, each of the programmer contacts 402A–402F are closed, while the programmer contacts 402G are open. As a result, each of the cylinders 150A–150F is in its extended position. Consequently, the housing is positioned by the indexing assembly 70 to present a first cavity 122 to the insertion station, this cavity being one of the cavities in the back row of the housing 58.

Following the individual insertion operations, the contacts 402A–402F are opened in sequence thereby in sequence to retract the cylinders 150A–150F. The number of operations of the programmer and the sequence of operation of its contacts can be arranged by programming of the programmer 400 in accordance with known practice.

In the operation of the machine 50, initially a connector housing 58 is loaded into the housing support structure 64, and a supply of terminated wires 54 of the desired length and characteristiccs are loaded in the desired sequence within the left hand and right hand bins 200 and 202. The programmer is set to operate the contacts 402A–402F in a desired sequence corresponding with the alternate left hand - right hand loading sequence to be used by the operator.

When the machine 50 is loaded and prepared, the first terminated wire 54 is loaded into the loading station 52 and closes the switch 204. With reference to FIG. 30, when switch 204 closes a circuit is completed for the energization of a solenoid 408. Solenoid 408 (FIG. 31) is connected in controlling relation to a valve 410 in turn controlling the pressurization of the pneumatic cylinder 234. Consequently, energization of solenoid 408 results in extension of piston 235 and in retraction of the sliding guide member 222. In addition, movement of the piston 235 results in raising of the actuating pin 256 associated with one of the transfer gripping assemblies 80. As a result, jaws 246 close to hold the inserted terminated wire while the loading guide assembly 76 moves to a retracted position.

Closing of switch 204 also extends a circuit to a portion of the transfer sensing switch 284 thereby to initiate operation of the transfer assembly 78. More specifically, as illustrated in FIG. 30, switch 284 includes two sets of switch contacts 284A and 284B in circuit respectively with a pair of solenoids 412 and 414. These solenoids are connected to control the movement of a four-way valve 416 (FIG. 31) connected between a source of pressurized air and the rotary actuator 270. When switch 204 is closed during the first insertion cycle, contacts 284A are closed and solenoid 412 is energized. Consequently, the rotary actuator is operated to move the transfer arm 240 of the transfer assembly 78 in a counterclockwise direction as viewed in FIG. 1 of the drawings. This movement results in a movement of the terminated wire from the loading station 52 to the insertion station 56.

When the terminated wire releases the switch 204, solenoid 408 is deenergized returning the loading guide assembly 76 to its initial condition ready to accept the subsequent terminated wire. However, a relay 418 in series with solenoid 412 includes a normally open set of latching contacts 418A in series with the solenoid 412 so that opening of switch 204 does not result in deenergization of solenoid 412 and stopping of the transfer arm 240. Energization of relay 418 also results in closing of a normally open set of relay contacts 418B in series with an additional set of switch contacts 284C forming a part of switch 284.

When the transfer assembly 78 nears its final position, the transfer sensing switch 284 is operated to its alternate position by means of the switch actuator arm 286. Contacts 284A and 284B perform no function at this time because the loading sensing switch 204 is open. However, closure of contacts 284C completes a circuit through closed relay contacts 418B and through the normally closed contacts of the second insertion sensing switch 356. This circuit energizes a pair of solenoids 420 and 422 and the winding of a relay 424. When relay 424 is energized, a pair of normally closed relay contact 424A and 424B open to prevent energization of either the solenoid 412 or the solenoid 414 to the end that the rotary actuator 270 associated with the transfer assembly 78 cannot be operated during the insertion operation.

Returning to the operation of the switch 284, after operation of the transfer assembly 78 the switch assumes the condition alternate to that illustrated in FIG. 30. After completion of the insertion operation when the previously loaded terminated wire is inserted, closure of the switch 204 results in energization of the solenoid 414 to produce a clockwise movement rather than a counterclockwise movement. Simultaneously a relay 426 is energized to close a pair of latching relay contacts 426A. At the end of the clockwise movement of the transfer assembly 78, a set of switch contacts 284D are closed to complete a circuit through closed relay contacts 426B and through the normally closed second insertion sensing switch 356. The counterclockwise and clockwise movements take place alternately, and at the end of each operation of the transfer assembly 78, an insertion operation is begun in substantially the same manner for both counterclockwise and clockwise operations of the transfer assembly.

Referring to FIG. 31, the solenoid 420 is connected to control a spring loaded four-way valve 428 connected between the pressure source and the rotary actuator 310. Movement of valve 428 by solenoid 420 from the illustrated position to the opposite position results in a closing movement of the jaws 304 of the insertion gripping assembly 302.

Solenoid 422 is connected to control the operation of a pneumatic valve 430 coupled between the pressure source and the air cylinder 154. Therefore, energization of solenoid 422 results in extension of the housing support structure 64 from the retracted position to the position above the insertion station 65.

When this extension movement of the housing support structure 56 is carried out, the extension sensing switch 156 is operated from its illustrated position to its alternate position. At this time, a set of switch contacts 156A close to energize the programmer solenoid 402 of the programmer 400. This results in cocking of the programmer 400 so that the programmer is prepared to be stepped when solenoid 402 is next deenergized.

Operation of switch 156 also results in the closing of a set of switch contacts 156B connected in series with a solenoid 432. Solenoid 432 as shown in FIG. 31 is connected to control the operation of a spring loaded three-way valve 434 connected to the first insertion air cylinder. At this time the housing support structure 64 moves downwardly to capture the tip of the terminal 54B in the predetermined cavity 122. Index head assembly 68 continues to move down in order to release the transfer gripping assembly 80.

Downward movement of the index head assembly 68 also results in operation of the first insertion sensing switch 338. With reference to FIG. 3, it can be seen that closing of switch 338 completes a circuit for energization of a solenoid 436. Solenoid 436 (FIG. 31) is coupled to a valve 438 connected in controlling relation to the second insertion pneumatic cylinder 344. Thus, the piston 346 is extended to lift the insertion gripping assembly 302 and complete the terminal insertion operation.

The wire guide cylinder 298 is also controlled by the valve 438. The guide piston 300 is normally extended, and when solenoid 436 is energized to move valve 438, the guide piston 300 is retracted.

At the end of the insertion movement of the second insertion air cylinder 344, the second insertion sensing switch 356 is operated in order to reset the circuit 86 for another loading and insertion operation. More specifically, when switch 356 opens, solenoid 420 is deenergized to operate the rotary actuator 310 in the opposite direction thereby to open the insertion gripping jaws 304. Relay 424 is deenergized in order to close relay contacts 424A and 424B in series with the transfer assembly solenoids, and the circuit is conditioned to accept the loading of the next terminated wire 54.

Opening of switch 356 also deenergizes solenoid 422 thereby retracting the pneumatic cylinder 154 in order to retract the housing support structure 64 from the region of the insertion station 56. This results in release of the extension sensing switch 156 and contacts 156A re-open to deenergize the programmer solenoid 402 and trigger operation of the programmer 400. As a result, selected programmer contacts 402A–402F are operated to reposition the housing support structure 64 through the agency of the indexing assembly 70 to accept the next terminated wire 54.

Release of switch 156 also results in opening of switch contacts 156B and deenergization of solenoid 432. As a result the first insertion air cylinder 330 retracts and the housing support structure 64 returns upwardly to its initial position.

Upward movement of the index head assembly 68 releases switch 338, which switch opens to deenergize the solenoid 436. Consequently, the wire guide piston 300 returns to its extended position and the second insertion cylinder 344 returns to its retracted position. At this time the second insertion sensing switch 356 recloses and the components of the machine 50 together with the elements of the circuit 86 and the circuit 88 are reset for the next cycle of operation.

When all of the terminated wires 54 associated with a given housing 58 have been inserted, the programmer 400 completes its final cycle of operation. In this cycle of operation, programmer contacts 402G close to energize a solenoid 442 associated (FIG. 31) with a valve 444. Valve 444 is connected to control the operation of the housing ejection cylinder 364 to the end that the completed harness or assembly 60 is ejected from the machine 50.

While the invention has been described with reference to details of the illusrated embodiment, it should be understood that these details are not intended to limit the invention as defined in the following claims.

What is claimed and desired to be secured by Letters Patent of the United States is:

1. In a connector assembly machine for assembling terminated wires into connector housings, the combination comprising:

a loading station disposed adjacent the front of the machine for receiving terminated wires;

insertion means spaced from said loading station for inserting terminated wires into connector housings;

a transfer assembly for moving terminated wires from said loading station to said insertion means;

said transfer assembly including a transfer structure movable between said loading station and said insertion means;

a pair of transfer gripping means mounted at spaced positions on said transfer structure each for gripping a terminated wire at said loading station; and control means for positioning one said transfer gripping means at said loading station and simultaneously positioning the other said transfer gripping means at said insertion means.

2. The combination of claim 1, said transfer structure including an arm member pivotable about an axis between said loading station and said insertion means, said transfer gripping means being located adjacent the ends of said arm.

3. The combination of claim 2, further comprising drive means coupled to said arm member for oscillating said arm through 180°.

4. The combination of claim 3, further comprising first and second bin means at either side of said loading station for supporting a supply of terminated wires.

5. The combination of claim 1, further comprising operating means at said loading station for closing said transfer gripping means in response to the loading of a terminated wire.

6. The combinationn of claim 1, said insertion means including gripping means for gripping a terminated wire, and actuating means for operating said insertion gripping means and for releasing said transport gripping means.

7. A connector assembly machine for assembling terminated wires into connector housings comprising:

frame means;

a loading station supported by said frame means and including a guide assembly for guiding a terminated wire into said loading station;

cycle start sensing means for sensing the presence of a terminated wire at said loading station;

an insertion station spaced from said loading station;

a transfer assembly including first gripping means movable between said loading station and said insertion station;

first control means coupled between said cycle start sensing means, said guide assembly and said transfer assembly for operating said first gripping means to grip said terminated wire and for retracting said guide assembly from said loading station and for operating said transfer assembly to move said first gripping means to said insertion station in response to operation of said cycle start sensing means;

housing support means mounted for movement adjacent said insertion station;

second gripping means adjacent said insertion station for gripping said terminated wire at said insertion station;

second control means coupled between said transfer assembly, said housing support means and said second gripping means, and operable in response to the movement of a wire to said insertion station for operating said second gripping means and for moving said housing support means toward the terminated wire to a partly assembled position;

release means engageable with said first gripping means for releasing said first gripping means in response to movement of said housing support means to said partly assembled position; and insertion means for moving said second gripping means toward said housing support means to complete the insertion of the terminated wire into the housing.

8. The machine of claim 7, further comprising programmable indexing means connected to said housing support means for locating said housing in predetermined positions relative to said second gripping means.

9. The machine of claim 7, said transfer assembly including a plurality of said first gripping means positioned in sequence at said loading station.

10. The machine of claim 9, said transfer assembly comprising a rotatable arm having a first gripping assembly adjacent each end, and means for positioning said arm with one first gripping assembly at said loading station and the other first gripping assembly at said insertion station.

11. A connector assembly machine for inserting wires having terminals at an end thereof into electrical connector housings, said machine comprising:

a loading station at which a terminated wire is loaded into the machine;

an insertion station at which the terminated wire is inserted into the housing;

holding means adjacent said insertion station for holding said housing;

sensing means at said loading station for sensing the loading of the terminated wire into the machine;

transfer gripping means responsive to operation of said sensing means for gripping said terminated wire;

transfer means for moving said transfer gripping means from said loading station to said insertion station; and insertion means for joining said terminated wire and said housing.

12. The machine of claim 11, said transfer gripping means being arranged to grip the terminal portion of said terminated wire, and said insertion means including insertion gripping means for gripping the wire portion of said terminated wire.

13. The machine of claim 12, said insertion means including means for releasing said transfer gripping means at said insertion station after operation of said insertion gripping means.

14. The machinne of claim 13, said insertion means including means for starting the terminal partly into said housing prior to release of said transfer gripping means.

15. The machine of claim 14, said starting means comprising means coupled to said holding means for moving said housing while the terminated wire is held stationary by said transfer gripping means.

16. A connector assembly machine for inserting a plurality of terminated wires in predetermined cavities of a multicavity connector housing, said machine comprising:

a holding asssembly for holding the connector housing;

insertion means for moving a terminated wire into the connector housing;

indexing means for aligning said holding means and said insertion means to present the cavities of the housing to the insertion means in a predetermined sequence;

a loading station at which terminated wires are fed to the machine;

a transfer assembly for transporting terminated wires from said loading station to said insertion means, said transfer assembly including means for grasping a terminated wire at said loading station, and means for moving terminated wires in alternate right hand and left hand directions from said loading station; and bin means adjacent said loading station holding terminated wires in an array corresponding to said predetermined sequence, said bin means including bins on opposite sides of said loading station, said array comprising an alternated right hand and left hand array.

17. The machine of claim 16, said grasping means including two grasping structures alternately located at said loading station.

18. The machine of claim 16 further comprising control means operable in response to operation of said transfer assembly for disabling said transfer assembly until after operation of said insertion means.

19. A connector assembly machine for assembling terminated wires into the housings of electrical connectors, said machine comprising:

means defining a loading station accessible from the front of the machine for the hand oading of terminated wires into the machine;

first and second bin means disposed on opposite sides of said loading station for holding a supply of terminanted wires;

insertion means spaced from said loading station operable upon rreceipt of a terminated wire at the insertion means for inserting the terminated wire into a connector housing; and transport means for moving terminated wires from the loading station to the insertion means alternately along two paths extending in opposite directions from said loading station.

20. The machine of claim 19, said transport means comprising a structure mounted for pivotal movement around an axis spaced from said loading station.

21. The machine of claim 20, rotary drive means coupled to said structure; and control means for operating said rotary drive alternately in two directions.

22. The machine of claim 21, sensing means at said loading station for operating said control means in response to loading of a terminated wire.

23. A connector assembly machine for assembling terminated wires into connector housings and comprising:

means defining a loading station accessible at the front of the machine for the reception of terminated wires;

a guide member defining a loading path adjacent said loading station;

a transfer assembly including means for engaging a terminated wire at said loading station and for moving the terminated wire from the loading station;

means mounting said guide member for movement away from said loading station; and control means coupled to said mounting means and to said transfer assembly for moving said guide member and for operating said transfer assembly.

24. The machine of claim 23, further comprising sensing means at said loading station for sensing the loading of a terminated wire, and means coupled between said sensing means and said control means for operating said control means in response to operation of said sensing means.

25. A machine for automatically inserting a plurality of terminated wire leads one at a time into a connector housing having a plurality of corresponding terminal receiving cavities to produce a completed harness comprising:

a. a wire loading station whereat wire leads are manually fed to the machine;

b. an insertion station whereat wire leads are inserted into a connector housing;

c. a wire transfer assembly for transferring a wire lead from the loading station to the insertion station, said transfer assembly including a movable transfer structure, a pair of transfer gripping means for gripping a wire lead at the loading station mounted at spaced positions on the transfer structure so that one gripping means is at the loading station while the other gripping means is at the insertion station, and drive means for moving the transfer structure so that said pair of gripping means is moved in oscillating fashion in alternative opposite directions from the loading station to the insertion station; and d. an insertion assembly for positioning a connector at the insertion station and inserting a wire lead into the connector in a predetermined sequence.

26. The machine of claim 25 wherein said transfer structure includes an arm member pivotable about an axis between said loading station and said insertion means, said transfer gripping means being located adjacent the ends of said arm.

27. The machine of claim 25 including transfer actuating means for sensing the presence of a terminated wire lead at the loading station, closing said transfer gripping means in response thereto and actuating said transfer assembly so that said wire lead is moved from the loading station to the insertion station.

28. The machine of claim 27 including control means associated with the transfer actuating means for disabling said transfer assembly until after operation of said insertion assembly.

29. The machine of claim 25 including a pair of bin means for storing a plurality of wire leads prior to feeding them to the machine, one bin means being located to the left of the loading station and the other bin means being located to the right of said loading station.

30. A machine for automatically inserting a plurality of terminated wire leads one at a time into a connector housing having a plurality of corresponding terminal receiving cavities to produce a completed harness comprising:

a. a wire loading station whereat wire leads are manually fed to the machine;

b. an insertion station whereat wire leads are inserted into a connector housing;

c. a wire transfer assembly for transferring a wire lead from the loading station to the insertion station; and d. an insertion assembly for positioning a connector at the insertion station and inserting a wire lead into the connector in a predetermined sequence; said insertion assembly including i. a connector moving assembly which holds a connector housing having an indexing head assembly movable in three mutually perpendicular directions from an indexing position away from the insertion station wherein the connector housing is indexed so that a predetermined terminal receiving cavity can be presented, toward the transfer structure to a housing presentation position whereat the predetermined terminal receiving cavity is adjacent to a wire lead at the insertion station, toward the wire lead to an insertion position whereat the wire lead is inserted into the predetermined terminal receiving cavity, back to the presentation position, and away from the transfer structure to the indexing position, said connector moving assembly including indexing drive means for indexing the head assembly when in the indexing position, wire sensing means for sensing when a wire lead is at the insertion station, terminal insertion sensing means for sensing when a wire lead has been inserted in the connector housing, and connector drive means for moving the head assembly from the indexing position to the insertion position in response to the wire sensing means and from the insertion position to the terminal sensing means, and ii. a wire moving asssembly having second wire gripping means for grasping and moving a wire lead at the insertion station, wire gripping drive means for actuating said second wire gripping means in response to the wire sensing means, moving a grasped wire lead toward said connector housing for insertion therein and de-actuating said second wire gripping means in response to the terminal sensing means.

31. The machine of claim 30 including a wire guide assembly at the insertion station for positioning a wire lead prior to insertion and for ppreventing previously inserted wire leads from entering the insertion station.

32. The machine of claim 31 wherein said wire transfer assembly includes a transfer structure, said wire guide assembly including a member spaced from said transfer structure, ssaid space between said transfer structure and said member defining said insertion station and preventing wire lead movement in a direction toward said transfer structure and an opposite direction toward said member, said member being mounted for movement between a normal position and a retracted position in response to the terminal sensing means so that an inserted wire lead can be moved in a direction away from said transfer structure, said member returning to its normal position when the head assembly is in its indexing position, whereby said inserted wire lead is prevented from re-entering the insertion station when the head assembly is moved to its presentation position during the successive cycles.

33. The machine of claim 30 including programmable indexing control means associated with said indexing drive means for dictating which movement shall be made by the head assembly to present the next predetermined terminal cavity over the insertion station.

34. The machine of claim 30 wherein said transfer assembly includes a movable transfer structure, transfer gripping means for gripping a wire lead about the terminal portion thereof while at the loading station, and drive means for moving the transfer structure.

35. The machine of claim 34 wherein said transfer assembly includes means for releasing the transfer gripping means in response to the terminal insertion sensing means sensing that the tip of a terminal has entered its respective terminal cavity.

36. The machine of claim 30 wherein said indexing head assembly includes a housing support structure having a nest member defining a recess for holding a connector housing, a latch plate overlying said recess for preventing removal of the housing, means mounting the latch plate for pivotal movement, and means including cam means for pivoting said latch plate away from said recess to permit removal of the housing.

37. A machine for automatically inserting a plurality of terminated wire leads one at a time into a connector housing having a plurality of corresponding terminal receiving cavities to produce a completed harness comprising:

a. a wire loading station whereat wire leads are manually fed to the machine;

b. an insertion station whereat wire leads are inserted into a connector housing;

c. a pair of bin means for storing a plurality of wire leads prior to feeding them to the machine, one bin means being located adjacent the left of the loading station and the other bin means being located adjacent the right of said loading station;

d. a wire transfer assembly for transferring a wire lead from the loading station to the insertion station, said transfer assembly including a movable transfer structure, a pair of transfer gripping means for gripping a wire lead at the loading station mounted at spaced positions on the transfer structure so that one gripping means is at the loading station while the other gripping means is at the insertion station, and drive means for moving the transfer structure so that said pair of gripping means is moved in oscillating fashion in alternative opposite directions from the loading station to the insertion station;

e. an insertion assembly for positioning a connector at the insertion station annd inserting a wire lead into the connector in a predetermined sequence, said insertion assembly including i. a connector moving assembly which holds a connector housing having an indexing head assembly movable in three mutually perpendicular directions from an indexing position away from the insertion station wherein the connector housing is indexed so that a predetermined terminal receiving cavity can be presented, toward the transfer structure to a housing presentation position whereat the predetermined terminal receiving cavity is adjacent to a wire lead at the insertion station, toward the wire lead to an insertion position whereat the wire lead is inserted into the predetermined terminal receiving cavity, back to the presentation position, and away from the transfer structure to the indexing position, said connector moving assembly including indexing drive means for indexing the head assembly when in the indexing position, wire sensing means for sensing when a wire lead is at the insertion station, terminal insertion sensing means for sensing when a wire lead has been inserted in the connector housing, and connector drive means for moving the head assembly from the indexing position to the insertion position in response to the wire sensing means and from the insertion position to the terminal sensing means, and ii. a wire moving assembly having second wire gripping means forr grasping and moving a wire lead at the insertion station, wire gripping drive means for actuating said second wire gripping means in response to the wire sensing means, moving a grasped wire lead toward said connector housing for insertion there and deactuating said second wire gripping means in response to the terminal sensing means; and f. a wire guide assembly at the insertion station for positioning a wire lead prior to insertion and for preventing previously inserted wire leads from entering the insertion station, said wire guide assembly including a member spaced from said transfer structure, said space between said transfer structure and said member defining said insertion station and preventing wire lead movement in a direction toward said transfer structure and an opposite direction toward said member, said member being mounted for movement between a normal position and a retracted position in response to the terminal insertion sensing means so that an inserted wire lead can be moved in a direction away from said transfer structure, said member returning to its normal position when the head assembly is in its indexing position, whereby said inserted wire lead is prevented from re-entering the insertion station when the head assembly is moved to its presentation position during the successive cycles.

38. The machine of claim 37 wherein said transfer structure includes an arm member pivotable about an axis between said loading station and said insertion means, said transfer gripping means being located adjacent the ends of said arm.

39. The machine of claim 37 including transfer actuating means for sensing the presence of a terminated wire lead at the loading station, closing said transfer gripping means in response thereto and actuating said transfer assembly so that said wire lead is moved from the loading station to the insertion station.

40. The machine of claim 39 including control means associated with the transfer actuating means for disabling said transfer assembly until after operation of said insertion assembly.

41. The machine of claim 37 including programmable indexing control means associated with said indexing drive means for dictating which movement shall be made by the head assembly to present the next predetermined terminal cavity over the insertion station.

42. The machine of claim 37 wherein said transfer assembly includes means for releasing the transfer gripping means in response to the terminal insertion sensing means sensing that the tip of a terminal has entered its respective terminal cavity.

43. The machine of claim 37 wherein said indexing head assembly includes a housing support structure having a next member defining a recess for holding a connector housing, a latch plate overlying said recess for preventing removal of the housing, means mounting the latch plate for pivotal movement, and means including cam means for pivoting said latch plate away from said recess to permit removal of the housing.

* * * * *